US010161207B2

(12) United States Patent
Ravensbergen et al.

(10) Patent No.: US 10,161,207 B2
(45) Date of Patent: Dec. 25, 2018

(54) APPARATUS, SYSTEM AND METHOD FOR TREATING A RESERVOIR USING RE-CLOSEABLE SLEEVES AND NOVEL USE OF A SHIFTING TOOL

(71) Applicant: NCS MULTISTAGE INC., Calgary (CA)

(72) Inventors: John Edward Ravensbergen, Calgary (CA); Don Getzlaf, Calgary (CA)

(73) Assignee: NCS Multistage Inc., Calgary (CA)

( * ) Notice: Subject to any disclaimer, the term of this patent is extended or adjusted under 35 U.S.C. 154(b) by 88 days.

(21) Appl. No.: 14/978,483

(22) Filed: Dec. 22, 2015

(65) Prior Publication Data

US 2016/0215590 A1 Jul. 28, 2016

Related U.S. Application Data

(60) Provisional application No. 62/095,859, filed on Dec. 23, 2014.

(51) Int. Cl.

| | |
|---|---|
| ***E21B 23/00*** | (2006.01) |
| ***E21B 34/10*** | (2006.01) |
| ***E21B 34/12*** | (2006.01) |
| ***E21B 34/14*** | (2006.01) |

(52) U.S. Cl.

CPC ..... *E21B 23/006* (2013.01); *E21B 34/102* (2013.01); *E21B 34/12* (2013.01); *E21B 34/14* (2013.01)

(58) Field of Classification Search

CPC .... E21B 43/26; E21B 2034/007; E21B 34/14; E21B 34/102

See application file for complete search history.

(56) References Cited

U.S. PATENT DOCUMENTS

| | | | | |
|---|---|---|---|---|
| 4,949,788 A * | 8/1990 | Szarka | ..... | E21B 23/006 166/285 |
| 5,513,703 A * | 5/1996 | Mills | ..... | E21B 23/04 166/316 |
| 2014/0048271 A1* | 2/2014 | Coon | ..... | E21B 34/102 166/308.1 |

* cited by examiner

*Primary Examiner* — D. Andrews
*Assistant Examiner* — Jonathan Malikasim
(74) *Attorney, Agent, or Firm* — Ridout & Maybee LLP

(57) ABSTRACT

There is provided a method of stimulating a formation within a wellbore that is lined with a wellbore string, the wellbore string including a port and a flow control member, wherein the flow control member is displaceable relative to the port for effecting opening and closing of the port. The port is opened by displacing the flow control member in response to an applied pressure differential across a sealing interface. The port is closed by displacing the flow control member with hydraulic hold down buttons prior to removing the sealing interface and effecting pressure equalization.

13 Claims, 14 Drawing Sheets

APPARATUS, SYSTEM AND METHOD FOR TREATING A RESERVOIR USING RE-CLOSEABLE SLEEVES AND NOVEL USE OF A SHIFTING TOOL

FIELD

This disclosure relates to treatment material of a hydrocarbon-containing reservoir.

BACKGROUND

Closeable sleeves are useful to provide operational flexibility during fluid treatment of a hydrocarbon-containing reservoir. Existing forms of such closeable sleeve are overly complicated and include unnecessary components, and are prone to unnecessary mechanical stresses. Also, problems exist with closing these sleeves immediately after fluid treatment, owing to the existence of solid materials in the vicinity of the treatment material port.

SUMMARY

In one aspect, there is provided a method of stimulating a formation within a wellbore that is lined with a wellbore string, the wellbore string including a port and a flow control member, wherein the flow control member is displaceable relative to the port for effecting opening and closing of the port, comprising:

deploying a workstring including a bottomhole assembly within the wellbore string, wherein the bottomhole assembly includes:

an uphole assembly portion including a valve plug and an actuatable second shifting tool;

a downhole assembly portion including a valve seat and an actuatable first shifting tool;

actuating the first shifting tool such that the first shifting tool becomes disposed in gripping engagement with the flow control member;

establishing a first sealing interface, wherein the sealing interface is effected, at least in part, by:

(a) seating of the valve plug on the valve seat;

(b) sealing engagement or substantially sealing engagement between an actuated sealing element and the flow control member; and applying a displacement-urging pressure differential across the sealing interface by supplying of pressurized fluid uphole of the sealing interface such that, in response, the actuated first shifting tool urges displacement of the flow control member in a downhole direction such that the opening of the port is effected by the displacement;

after the displacing of the flow control member from the closed position to the open position, and while the port is opened, and a pressure differential is existing across the sealing interface, applying a first actuating pressure differential uphole of the sealing interface such that the second shifting tool is actuated and becomes disposed in engagement with the flow control member such that the second shifting tool is exerting a first gripping force against the flow control member;

while the first actuating pressure differential is being applied, applying a tensile force to the workstring that is (i) insufficient to effect displacement of the flow control member relative to the port such that the port becomes closed, and (ii) with effect that the workstring becomes disposed in tension;

reducing the first actuating pressure differential being applied such that a second actuating pressure differential, less than the first actuating pressure differential, is being applied such that the second shifting tool is exerting a second gripping force, less than the first gripping force, against the flow control member;

wherein:

the second gripping force is sufficiently low such that, while the second gripping force is being exerted, the tension in the workstring is sufficient to effect uphole displacement of the second shifting tool relative to the flow control member such that the upper assembly portion is displaced uphole relative to the bottom assembly portion such that the valve plug becomes unseated relative to the valve seat such that the fluid pressure, resisting uphole displacement of the flow control member, is at least reduced;

the uphole displacement is insufficient to effect displacement of the second shifting tool uphole of the flow control member such that the second shifting tool remains engaged to the flow control member;

and after the sealing interface has been removed, and while the second shifting tool is exerting a gripping force against the flow control member, pulling the workstring uphole such that the pulling up of the second shifting tool effects displacement of the flow control member to the closed position.

In another aspect, there is provided a method of stimulating a formation within a wellbore that is lined with a wellbore string, the wellbore string including a port and a flow control member, wherein the flow control member is displaceable relative to the port for effecting opening and closing of the port, comprising:

deploying a workstring including a bottomhole assembly within the wellbore string, wherein the bottomhole assembly includes:

an uphole assembly portion including a valve plug and an actuatable second shifting tool;

a downhole assembly portion including a valve seat and an actuatable first shifting tool;

actuating the first shifting tool such that the first shifting tool becomes disposed in gripping engagement with the flow control member;

establishing a first sealing interface, wherein the sealing interface is effected, at least in part, by:

(a) sealing engagement or substantially sealing engagement between an actuated sealing element and the flow control member;

(b) seating of the valve plug on the valve seat;

applying a displacement-urging pressure differential across the sealing interface by supplying of pressurized fluid uphole of the sealing interface such that, in response, the actuated first shifting tool urges downhole displacement of the flow control member relative to the port such that the opening of the port is effected by the displacement;

after the displacing of the flow control member, and while the port is opened, and a pressure differential is existing across the sealing interface, actuating the second shifting tool such that the second shifting tool is exerting a gripping force against the flow control member; and while a reduced pressure differential is existing across the sealed interface, and while the second shifting tool is exerting a gripping force against the flow control member, applying an uphole force to the workstring such that the second shifting tool effects uphole displacement of the flow control member such that the port becomes closed.

BRIEF DESCRIPTION OF DRAWINGS

The preferred embodiments will now be described with the following accompanying drawings, in which.

DETAILED DESCRIPTION

Figure 1:
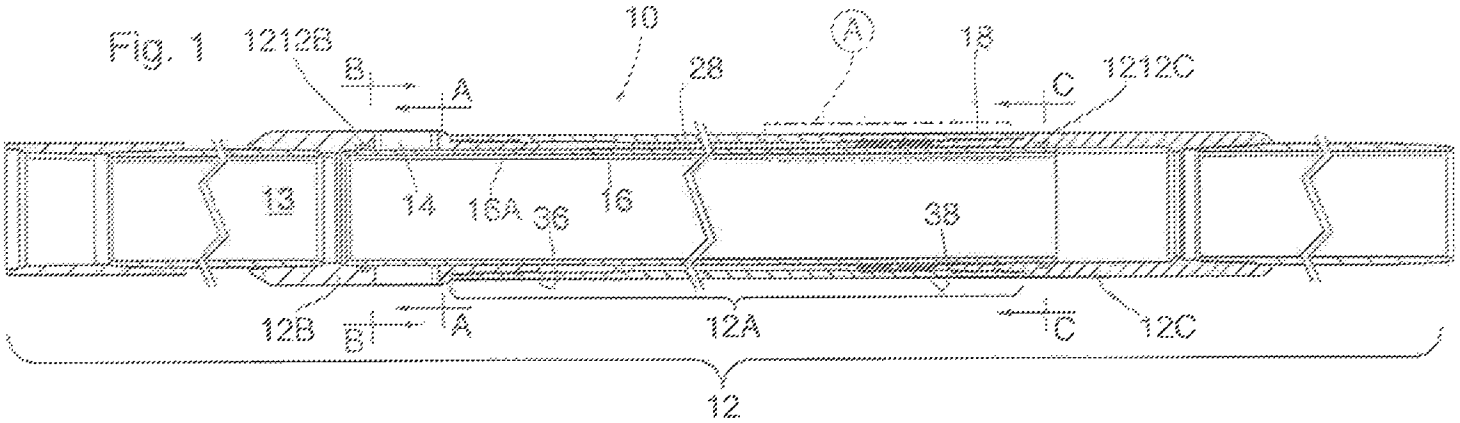
FIG. 1 is a side sectional view of an embodiment of a flow control apparatus of the present disclosure, incorporated within a wellbore string, with the valve closure member disposed in the closed position.

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole" mean, relativistically, further away from the surface and in closer proximity to the bottom of the wellbore, when measured along the longitudinal axis of the wellbore.

Referring to FIGS. 5 to 8, there is provided a downhole tool system including a flow control apparatus 10 and a bottomhole assembly 100. The downhole tool system is configured for effecting selective stimulation of a subterranean formation 102, such as a hydrocarbon-containing reservoir.

The stimulation is effected by supplying treatment material to the subterranean formation.

In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

The flow control apparatus 10 is configured to be integrated within a wellbore string 11 that is deployable within the wellbore 104. Suitable wellbores 102 include vertical, horizontal, deviated or multi-lateral wells. Integration may be effected, for example, by way of threading or welding.

The wellbore string 11 may include pipe, casing, or liner, and may also include various forms of tubular segments, such as the flow control apparatuses 100 described herein. The wellbore string 11 defines a wellbore string passage 2

Successive flow control apparatuses 10 may be spaced from each other within the wellbore string 11 such that each flow control apparatus 10 is positioned adjacent a producing interval to be stimulated by fluid treatment effected by treatment material that may be supplied through a port 14 (see below).

Referring to FIG. 1, in some embodiments, for example, the flow control apparatus 10 includes a housing 8. A passage 13 is defined within the housing 8. The passage 13 is configured for conducting treatment material, that is received from a supply source (such as a supply source disposed at the surface), to a flow control apparatus port 14 that is also defined within and extends through the housing 8. As well, in some embodiments, for example, the passage 13 is configured to receive a bottomhole assembly 100 (see below) to actuate a flow control member 16 of the flow control apparatus 10 (see below). In some embodiments, for example, the flow control apparatus 10 is a valve apparatus, and the flow control member 16 is a valve closure member.

In some embodiments, for example, the housing 8 includes an intermediate housing section 12A (such as a "barrel"), an upper crossover sub 12B, and a lower crossover sub 12C. The intermediate housing section 12A is disposed between the upper and lower crossover subs 12B, 12C. In some embodiments, for example, the intermediate housing section 12A is disposed between the upper and lower crossover subs 12B, 12C, and is joined to both of the upper and lower crossover subs with threaded connections. Axial and torsional forces may be translated from the upper crossover sub 12B to the lower crossover sub 12C via the intermediate housing section 12A.

The housing 8 is coupled (such as, for example, threaded) to other segments of the wellbore string 11, such that the wellbore string passage 2 includes the housing passage 13. In some embodiments, for example, the wellbore string 11 is lining the wellbore 104. The wellbore string 11 is provided for, amongst other things, supporting the subterranean formation within which the wellbore is disposed. As well, in some embodiments, for example, the wellbore string passage 2 of the wellbore string 11 functions for conducting treatment material from a supply source. The wellbore string 11 may include multiple segments, and the segments may be connected (such as by a threaded connection).

In some embodiments, for example, it is desirable to inject treatment material into a predetermined zone (or "interval") of the subterranean formation 102 via the wellbore 104. In this respect, the treatment material is supplied into the wellbore 104, and the flow of the supplied treatment material is controlled such that a sufficient fraction of the supplied treatment material (in some embodiments, all, or substantially all, of the supplied treatment material) is directed, via a flow control apparatus port 14 of the flow control apparatus 10, to the predetermined zone. In some embodiments, for example, the flow control apparatus port 14 extends through the housing 8. During treatment, the flow control apparatus port 14 effects fluid communication between the passage 13 and the subterranean formation 102. In this respect, during treatment, treatment material being conducted from the treatment material source via the passage 13 is supplied to the subterranean formation 102 via the flow control apparatus port 14.

As a corollary, the flow of the supplied treatment material is controlled such that injection of the injected treatment material to another zone of the subterranean formation is prevented, substantially prevented, or at least interfered with. The controlling of the flow of the supplied treatment material, within the wellbore 104, is effected, at least in part, by the flow control apparatus 10.

In some embodiments, for example, conduction of the supplied treatment to other than the predetermined zone may be effected, notwithstanding the flow control apparatus 10, through an annulus 112, that is disposed within the wellbore 104, between the wellbore string 11 and the subterranean formation 102. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port 14 and the remote zone, is prevented, or substantially prevented, or at least interfered with, by a zonal isolation material 105. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the flow control apparatus port 14, or of any cement that has become disposed within the port 14, prior to cementing, the port 14 may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2™ grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the flow control apparatus 10 includes the flow control member 16, and the flow control member 16 is displaceable, relative to the flow control apparatus port 14, for effecting opening and closing of the flow control apparatus port 14. In this respect, the flow control member 16 is displaceable such that the flow control member 16 is positionable in open (see FIG. 4) and closed (see FIG. 1) positions. The open position of the flow control member 16 corresponds to an open condition of the flow control apparatus port 14. The closed position of the flow control member 16 corresponds to a closed condition of the flow control apparatus port 14.

In some embodiments, for example, in the closed position, the flow control apparatus port 14 is covered by the flow control member 16, and the displacement of the flow control member 16 to the open position effects at least a partial uncovering of the flow control apparatus port 14 such that the flow control apparatus port 14 becomes disposed in the open condition. In some embodiments, for example, in the closed position, the flow control member 16 is disposed, relative to the flow control apparatus port 14, such that a sealed interface is disposed between the passage 13 and the subterranean formation 102, and the disposition of the sealed interface is such that treatment material being supplied through the passage 13 is prevented, or substantially prevented, from being injected, via the flow control apparatus port 14, into the subterranean formation 102, and displacement of the flow control member 16 to the open position effects fluid communication, via the flow control apparatus port 14, between the passage 13 and the subterranean formation 102, such that treatment material being supplied through the passage 13 is injected into the subterranean formation 102 through the flow control apparatus port 14. In some embodiments, for example, the sealed interface is established by sealing engagement between the flow control member 16 and the housing 8. In some embodiments, for example, "substantially preventing fluid flow through the flow control apparatus port 14" means, with respect to the flow control apparatus port 14, that less than 10 volume %, if any, of fluid treatment (based on the total volume of the fluid treatment) being conducted through the passage 13 is being conducted through the flow control apparatus port 14.

In some embodiments, for example, the flow control member 16 includes a sleeve. The sleeve is slideably disposed within the passage 13.

In some embodiments, for example, the flow control member 16 is displaced from the closed position (see FIG. 1) to the open position (see FIG. 4) and thereby effect opening of the flow control apparatus port 14. Such displacement is effected while the flow control apparatus 10 is deployed downhole within a wellbore 104 (such as, for example, as part of a wellbore string 11), and such displacement, and consequential opening of the flow control apparatus port 14, enables treatment material, that is being supplied from the surface and through the wellbore 104 via the wellbore string 11, to be injected into the subterranean formation 102 via the flow control apparatus port 14. In some embodiments, for example, by enabling displacement of the flow control member 16 between the open and closed positions, pressure management during hydraulic fracturing is made possible.

In some embodiments, for example, the flow control member 16 is displaced from the open position to the closed position and thereby effect closing of the port 16. Displacing the flow control member 16 from the open position to the closed position may be effected after completion of the supplying of treatment material to the subterranean formation 102 through the flow control apparatus port 14. In some embodiments, for example, this enables the delaying of production through the flow control apparatus port 14, facilitates controlling of wellbore pressure, and also mitigates ingress of sand from the formation 102 into the casing, while other zones of the subterranean formation 102 are now supplied with the treatment material through other ports 14. In this respect, after sufficient time has elapsed after the supplying of the treatment material to a zone of the subterranean formation 102, such that meaningful fluid communication has become established between the hydrocarbons within the zone of the subterranean formation 102 and the flow control apparatus port 14, by virtue of the interaction between the subterranean formation 102 and the treatment material that has been previously supplied into the subterranean formation 102 through the flow control apparatus port 14, and, optionally, after other zones of the subterranean formation 102 have similarly become disposed in fluid communication with other ports 14, the flow control member(s) may be displaced to the open position so as to enable production through the wellbore. Displacing the flow control member 16 from the open position to the closed position may also be effected while fluids are being produced from the formation 102 through the flow control apparatus port 14, and in response to sensing of a sufficiently high rate of water production from the formation 102 through the flow control apparatus port 14. In such case, displacing the flow control member 16 to the closed position blocks, or at least interferes with, further production through the associated flow control apparatus port 14.

The flow control member 16 is configured for displacement, relative to the flow control apparatus port 14, in response to application of a sufficient force. In some embodiments, for example, the application of a sufficient force is effected by a sufficient fluid pressure differential that is established across the flow control member 16. In some embodiment embodiments, for example, for example, the sufficient force is established by a force, applied to a bottomhole assembly 100, and then translated, via the bottomhole assembly 100, to the flow control member 16 (see below). In some embodiments, for example, the sufficient force, applied to effect opening of the flow control apparatus port 14 is a flow control member opening force, and the sufficient force, applied to effect closing of the port is a flow control member closing force.

In some embodiments, for example, the housing 8 includes an inlet 9. While the apparatus 100 is integrated within the wellbore string 11, and while the wellbore string 11 is disposed downhole within a wellbore 104 such that the inlet 9 is disposed in fluid communication with the surface via the wellbore string 11, and while the flow control apparatus port 14 is disposed in the open condition, fluid communication is effected between the inlet 9 and the subterranean formation 102 via the passage 13, and via the flow control apparatus port 14, such that the subterranean formation 102 is also disposed in fluid communication, via the flow control apparatus port 14, with the surface (such as, for example, a source of treatment fluid) via the wellbore string 11. Conversely, while the flow control apparatus port 14 is disposed in the closed condition, at least increased interference, relative to that while the port 14 is disposed in the open condition, to fluid communication (and, in some embodiments, sealing, or substantial sealing, of fluid communication), between the inlet 9 and the subterranean formation 102, is effected such that the sealing, or substantial sealing, of fluid communication, between the subterranean formation 102 and the surface, via the flow control apparatus port 14, is also effected.

Figure 4:
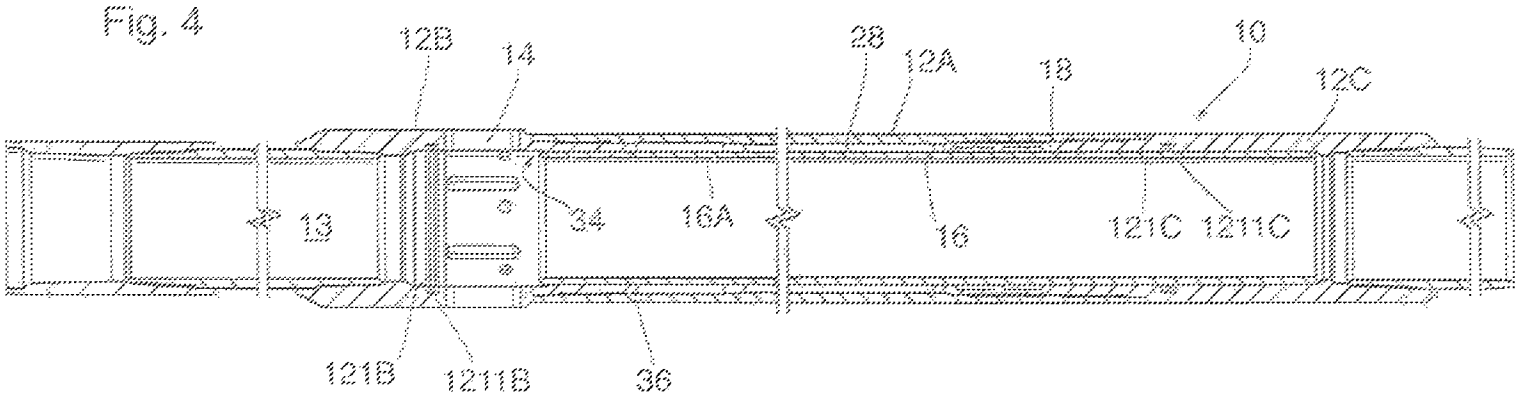
FIG. 4 is a side sectional view of the flow control apparatus, incorporated within a wellbore string, as illustrated in FIG. 1, with the flow control member disposed in the open position.

Referring to FIGS. 1 and 4, in some embodiments, for example, the housing 8 includes one or more sealing surfaces configured for sealing engagement with a flow control member 16, wherein the sealing engagement defines the sealed interface described above. In this respect, the internal surface 121B, 121C of each one of the upper and lower crossover subs, independently, includes a respective one of the sealing surfaces 1211B, 1211C, and the sealing surfaces 1211B, 1211C are configured for sealing engagement with the flow control member 16. In some embodiments, for example, for each one of the upper and lower crossover subs 12B, 12C, independently, the sealing surface 1211B, 1211C is defined by a respective sealing member 1212B, 1212C. In some embodiments, for example, when the flow control member 16 is in the closed position, each one of the sealing members 1212B, 1212C, is, independently, disposed in sealing engagement with both of the valve housing 8 (for example, the sealing member 1212B is sealingly engaged to the upper crossover sub 12B and housed within a recess formed within the sub 12B, and the sealing member 1212C is sealingly engaged to the lower crossover sub 12C and housed within a recess formed within the sub 12C) and the flow control member 16. In some embodiments, for example, each one of the sealing members 1212B, 1212C, independently, includes an o-ring. In some embodiments, for example, the o-ring is housed within a recess formed within the respective crossover sub. In some embodiments, for example, the sealing member 1212B, 1212C includes a molded sealing member (i.e. a sealing member that is fitted within, and/or bonded to, a groove formed within the sub that receives the sealing member).

In some embodiments, for example, the flow control apparatus port 14 extends through the housing 8, and is disposed between the sealing surfaces 1211B, 1211C.

In some embodiments, for example, the flow control member 16 co-operates with the sealing members 1212B, 1212C to effect opening and closing of the flow control apparatus port 14. When the flow control apparatus port 14 is disposed in the closed condition, the flow control member 16 is sealingly engaged to both of the sealing members 1212B, 1212C, and thereby preventing, or substantially preventing, treatment material, being supplied through the passage 13, from being injected into the subterranean formation 102 via the flow control apparatus port 14. When the flow control apparatus port 14 is disposed in the open condition, the flow control member 16 is spaced apart or retracted from at least one of the sealing members (such as the sealing member 1212B), thereby providing a passage for treatment material, being supplied through the passage 13, to be injected into the subterranean formation 102 via the flow control apparatus port 14.

Figure 4A:
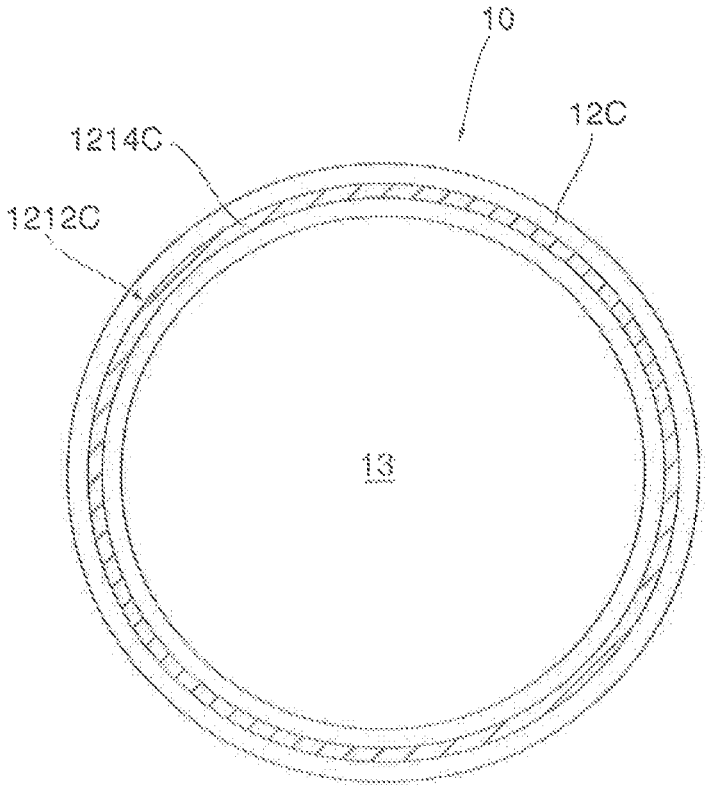
FIG. 4A is a sectional view taken along lines B-B in FIG. 1.
Figure 4B:
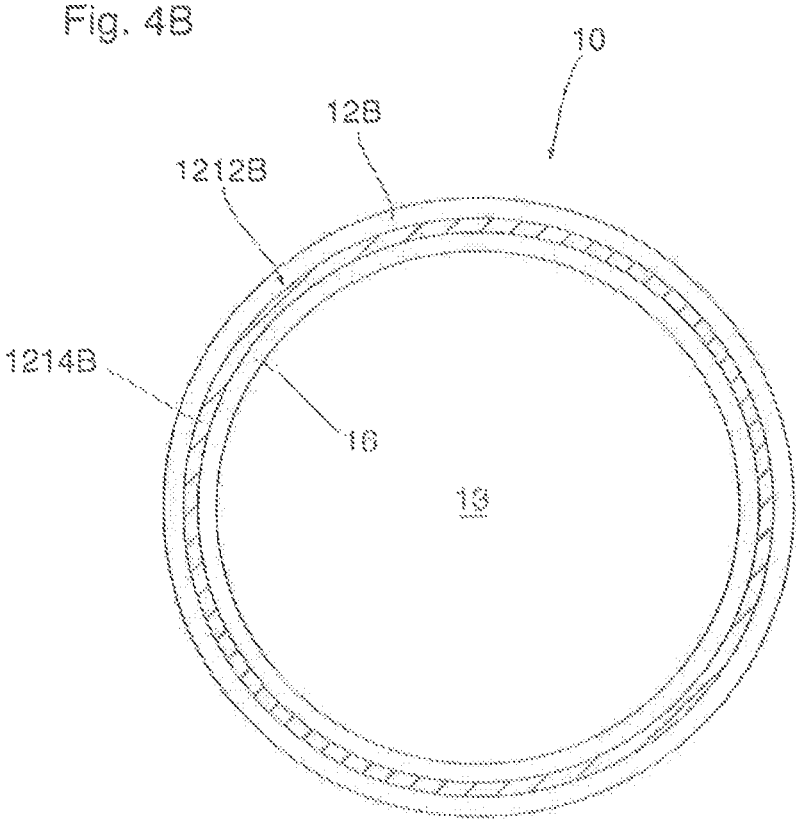
FIG. 4B is a sectional view taken along lines C-C in FIG. 1.

Referring to FIGS. 4A and 4B, in some embodiments, for example, each one of the sealing members 1212B, 1212C, independently, defines a respective fluid pressure responsive surface 1214B, 1214C, with effect that while the flow control member 16 is disposed in the closed position, and in sealing engagement with the sealing members 1212B, 1212C, each one of the fluid pressure responsive surfaces 1214B, 1214C, independently, is configured to receive application of fluid pressure from fluid disposed within the passage 13. In some embodiments, for example, each one of the surfaces 1214B, 1214C, independently, extends between the valve housing 8 (for example, the surface 1214B extends from the upper crossover sub 12B, such as a groove formed or provided in the upper crossover sub 12B, and the surface 1214C extends from the lower crossover sub 12C, such as a groove formed or provided in the lower crossover sub 12C) and the flow control member 16. In one aspect, the total surface area of one of the surfaces 1214B, 1214C is at least 90% of the total surface area of the other one of the surfaces 1214B, 1214C. In some embodiments, for example, the total surface area of one of the surfaces 1214B, 1414C is at least 95% of the total surface area of the other one of the surfaces 1214B, 1214C. In some embodiments, for example, the total surface area of the surface 1214B is the same, or substantially the same, as the total surface area of the surface 1214C. By co-operatively configuring the surfaces 1214B, 1214C in this manner, inadvertent opening of the flow control member 16, by unbalanced fluid pressure forces, is mitigated.

Referring to FIGS. 1, 2, 2A, 2B, 2C, and 4, a resilient retainer member 18 extends from the housing 12, and is configured to releasably engage the flow control member 16 for resisting a displacement of the flow control member 16. In this respect, in some embodiments, for example, the resilient retainer member 18 includes at least one finger 18A, and each one of the at least one finger includes a tab 18B that engages the flow control member 16. In some embodiments, for example, the engagement of the tab 18B to the flow control member 16 is effected by disposition of the tab 18B within a recess of the flow control member 16.

In some embodiments, for example, the flow control apparatus 10 includes a collet 19 that extends from the housing 12, and the collet 19 includes the resilient retainer member 18.

In some embodiments, for example, the flow control member 16 and the resilient retainer member 18 are co-operatively configured such that engagement of the flow control member 16 and the resilient retainer member 18 is effected while the flow control member 16 is disposed in the open position and also when the flow control member 16 is disposed in the closed position. In this respect, while the flow control member 16 is disposed in the closed position, the resilient retainer member 18 is engaging the flow control member 16 such that resistance is being effected to displacement of the flow control member 16 from the closed position to the open position. In some embodiments, for example, the engagement is such that the resilient retainer member 18 is retaining the flow control member 16 in the closed position. Also in this respect, while the flow control member 16 is disposed in the open position, the resilient retainer member 18 is engaging the flow control member 16 such that resistance is being effected to displacement of the flow control member 16 from the open position to the closed position. In some embodiments, for example, the engagement is such that the resilient retainer member 18 is retaining the flow control member 16 in the open position.

Figure 2:
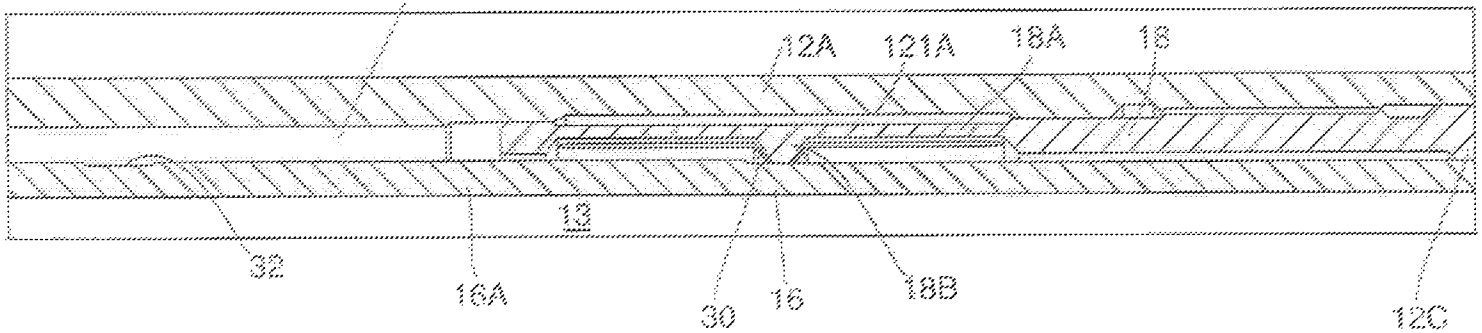
FIG. 2 is an enlarged view of Detail "A" of FIG. 1.
Figure 2A:
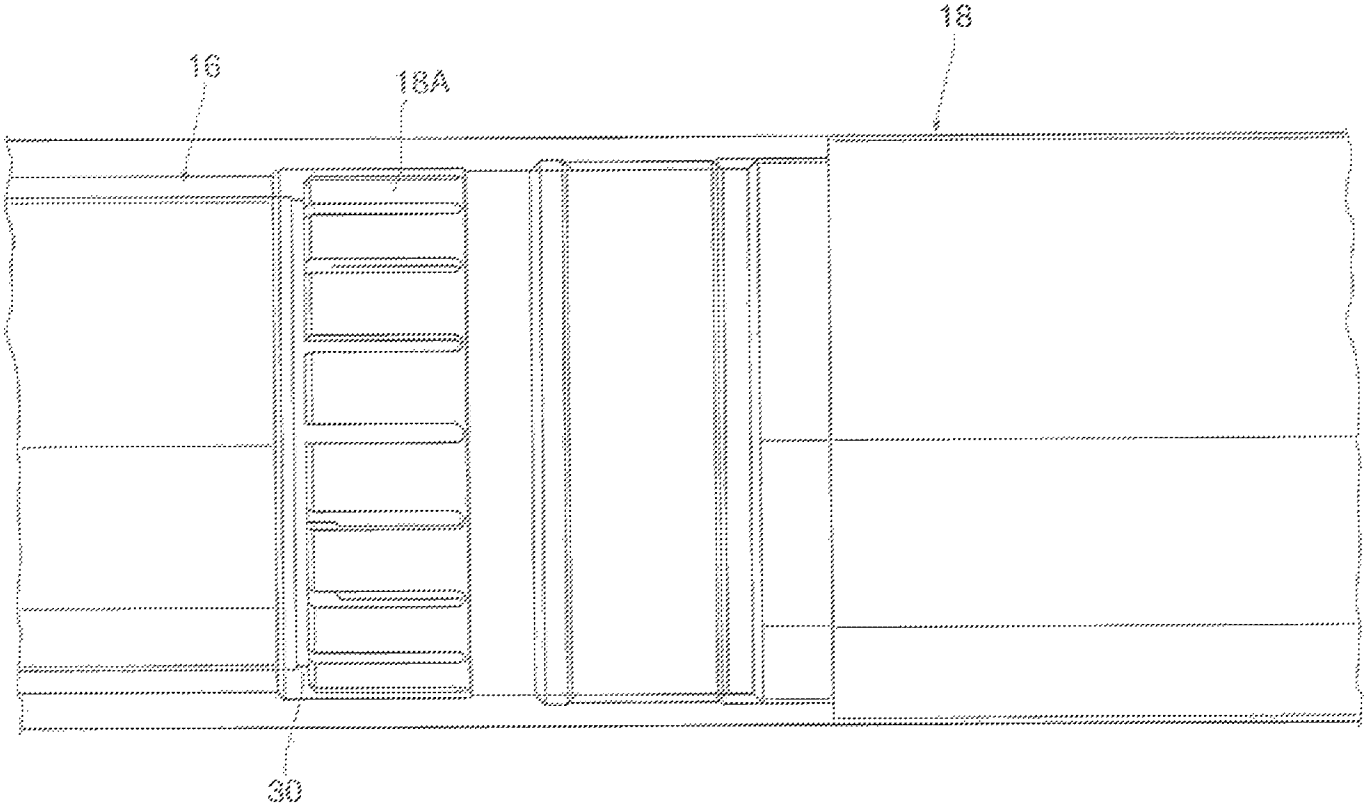
FIG. 2A is a detailed elevation view of a portion of the flow control apparatus of FIG. 1, illustrating the collet disposed in engagement with the closed position-defining recess of the valve closure member.
Figure 2B:
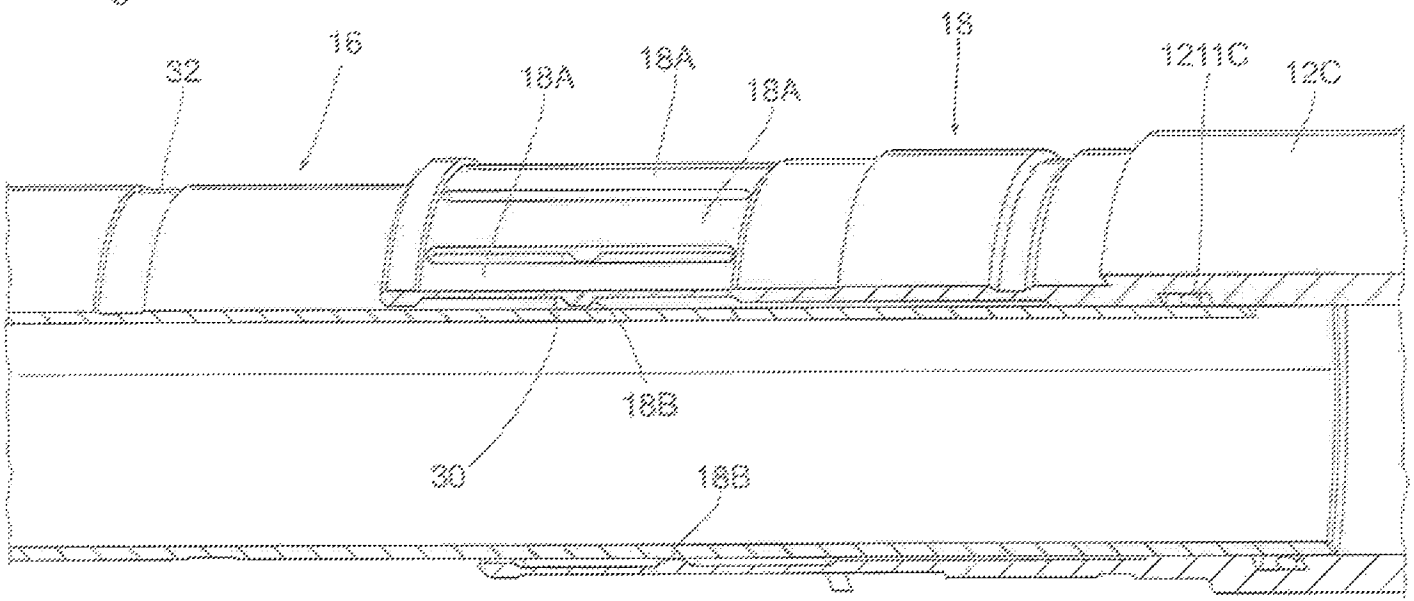
FIG. 2B is a detailed fragmentary perspective view of a portion of the flow control apparatus of FIG. 1, illustrating the collet disposed in engagement with the closed position-defining recess of the valve closure member.
Figure 2C:
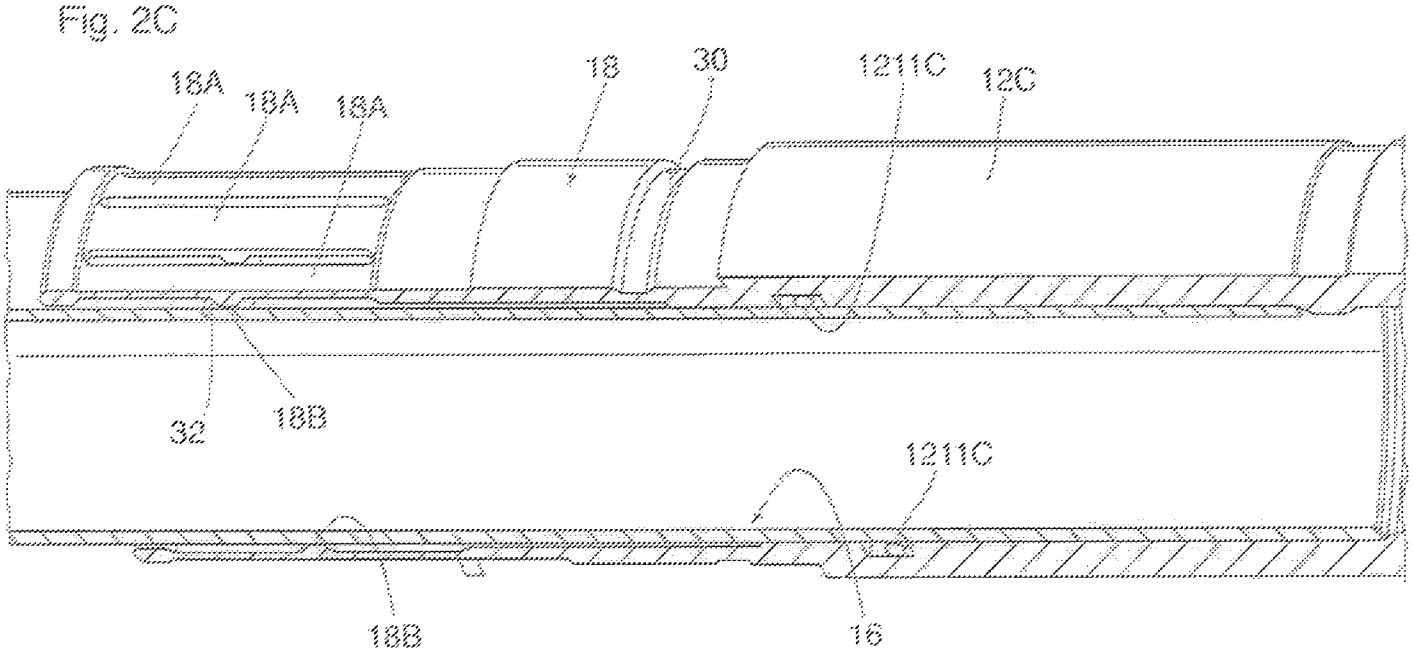
FIG. 2C is a detailed fragmentary perspective view of a portion of the flow control apparatus of FIG. 1, illustrating the collet disposed in engagement with the open position-defining recess of the valve closure member.

Referring to FIGS. 2 and 2A, in some embodiments, for example, the flow control member 16 includes a closed position-defining recess 30 and an open position-defining recess 32. The at least one finger 18A and the recesses 30, 32 are co-operatively configured such that while the flow control member 16 is disposed in the closed position, the finger tab 18B is disposed within the closed position-defining recess 30 (see FIG. 2B), and, while the flow control member 16 is disposed in the open position, the finger tab 18B is disposed within the open position-defining recess 32 (see FIG. 2C).

In some embodiments, for example, the resilient retainer member 18 is resilient such that the resilient retainer member 18 is displaceable from the engagement with the flow control member 16 in response to application of the opening force to the flow control member 16. In some embodiments, for example, such displacement includes deflection of the resilient retainer member 18. In some embodiments, for example, the deflection includes a deflection of a finger tab 18B that is disposed within a recess of the flow control member 16, and the deflection of the finger tab 18B is such that the finger tab 18B becomes disposed outside of the recess of the flow control member 16. When the flow control member 16 is disposed in the open position, such displacement removes the resistance being effected to displacement of the flow control member 16 from the open position to the closed position (and thereby permit the flow control member 16 to be displaced from the open position to the closed position, in response to application of an opening force). When the flow control member 16 is disposed in the closed position, such displacement removes the resistance being effected to displacement of the flow control member 16 from the closed position to the open position (and thereby permit the flow control member 16 to be displaced from the closed position to the open position, in response to application of a closing force).

In some embodiments, for example. in order to effect the displacement of the flow control member 16 from the closed position to the open position, the opening force is sufficient to effect displacement of the tab 18B from (or out of) the closed position-defining recess 30. In this respect, the tab 18B is sufficiently resilient such that application of the opening force effects the displacement of the tab 18B from the recess 30, such as by the deflection of the tab 18B. Once the finger tab 18B has become displaced out of the closed position-defining recess 30, continued application of force to the flow control member 16 (such as, in the illustrated embodiment, in a downwardly direction) effects displacement of the flow control member 16 from the closed position to the open position. In order to effect the displacement of the flow control member 16 from the open position to the closed position, the closing force is sufficient to effect displacement of the tab 18B from (or out of) the open position-defining recess 32, such as by deflection of the tab 18B. In this respect, the tab 18B is sufficiently resilient such that application of the closing force effects the displacement of the tab 18B from the recess 32. Once the tab 18*b* has become displaced out of the open position-defining recess 32, continued application of force to the flow control member 16 (such as, in the illustrated embodiment, in an upwardly direction) effects displacement of the flow control member 16 from the open position to the closed position.

Each one of the opening force and the closing force may be, independently, applied to the flow control member 16 mechanically, hydraulically, or a combination thereof. In some embodiments, for example, the applied force is a mechanical force, and such force is applied by a shifting tool. In some embodiments, for example, the applied force is hydraulic, and is applied by a pressurized fluid.

Figure 3:
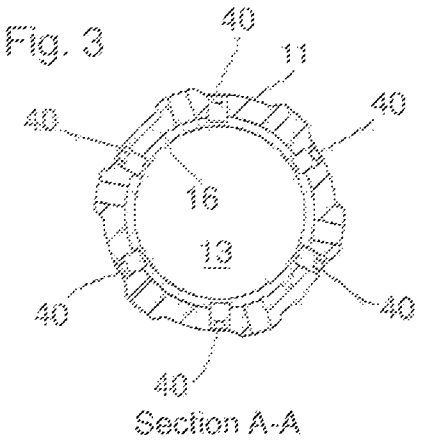
FIG. 3 is a sectional view taken along lines A-A in FIG. 1.

Referring to FIG. 3, in some embodiments, for example, while the apparatus 10 is being deployed downhole, the flow control member 16 is maintained disposed in the closed position by one or more shear pins 40. The one or more shear pins 40 are provided to secure the flow control member 16 to the wellbore string 11 (including while the wellbore string is being installed downhole) so that the passage 13 is maintained fluidically isolated from the formation 102 until it is desired to treat the formation 102 with treatment material. To effect the initial displacement of the flow control member 16 from the closed position to the open position, sufficient force must be applied to the one or more shear pins 40 such that the one or more shear pins become sheared, resulting in the flow control member 16 becoming moveable relative to the flow control apparatus port 14. In some operational implementations, the force that effects the shearing is applied by a workstring (see below).

Referring to FIGS. 1, 2 and 4, the intermediate housing section 12A and the flow control member 16 are co-operatively positioned relative to one another to define a retainer housing space 28 between the intermediate housing section 12A and the flow control member 16. In some of these embodiments, for example, each one of the sealing surfaces 1211B, 1211C (of the upper and lower crossover subs 12B, 12C), independently, is disposed closer to the axis of the passage 13 than an internal surface 121A of the intermediate housing section 121A. In some embodiments, for example, the internal surface 121A of the intermediate housing section 12A is disposed further laterally (e.g. radially) outwardly from the axis of the passage 13, relative to the sealing surfaces 1211B, 1211C, such that the retainer housing space 28 is disposed between the intermediate housing section 12A and the flow control member 16 while the flow control member 16 is disposed in sealing engagement to the sealing surfaces 1211B, 1211C, and thus disposed in the closed position.

The retainer housing space 28 co-operates with the flow control member 16 such that, at least while the flow control member 16 is disposed in the closed position, fluid communication between the retainer housing space 28 and the passage 13 is prevented or substantially prevented. By providing this configuration, the ingress of solid material, such as solid debris or proppant, from the passage 13 and into the retainer housing space 28, which may otherwise interfere with co-operation of the resilient retainer member 18 and the flow control member 16, and may also interfere with displacement of the flow control member 16, is at least mitigated.

In some embodiments, for example, such as in the embodiment illustrated in FIG. 4, while the flow control member 16 is disposed in the open position, at least some fluid communication may become established, within the wellbore string 11, between the passage 13 and the retainer housing space 28, albeit through a fluid passage 34, within the valve housing 8, defined by a space between the upper cross-over sub 12B and the flow control member 16, having a relatively small cross-sectional flow area, and defining a relatively tortuous flowpath. In this respect, in some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the passage 13 and the retainer housing space 28, has a maximum cross-sectional area of less than 0.20 square inches (such as 0.01 square inches). In some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the casing passage 13 and the retainer housing space 28, has a maximum cross-sectional area of less than 0.20 square inches (such as 0.01 square inches). By providing this configuration, the ingress of solid material, such as solid debris or proppant, from the passage 13 and into the retainer housing space 28, which may otherwise interfere with co-operation of the resilient retainer member 18 and the flow control member 16, and may also interfere with movement of the flow control member 16, is at least mitigated.

In some embodiments, for example, an additional sealing member may be disposed (such as, for example, downhole of the flow control apparatus port 14) within the space between the upper cross-over sub 12B and the flow control member 16 (for example, such as being trapped within a groove formed or provided in the upper crossover sub 12B), for sealing fluid communication between passage 13 and the retainer housing space 28, and, when the flow control member 16 is disposed in the open position, for sealing fluid communication between the flow control apparatus port 14 and the retainer housing space 28.

Referring to FIGS. 1 and 4, a vent hole 36 extends through the intermediate housing section 12A, for venting the retainer housing space 28 externally of the intermediate housing section 12A. By providing for fluid communication between the retainer housing space 28 and the formation 102 through the vent hole 36, the creation of a pressure differential between the formation 102 and the retainer housing space 28, and across the intermediate housing section 12A, including while the flow control member 16 is disposed in the closed position, is at least mitigated, and thereby at least mitigating application of stresses (such as hoop stress) to the intermediate housing section 12A. By mitigating stresses being applied to the intermediate housing section 12A, the intermediate housing section does not need to be designed to such robust standards so as to withstand applied stresses, such as those which may be effected if there existed a high pressure differential between the formation 102 and the space between the intermediate housing section and the flow control member 16. In some embodiments, for example, the intermediate housing section 12A may include 5½ American Petroleum Institute ("API") casing, P110, 17 pounds per foot. In some embodiments, for example, the section 12A includes mechanical tubing.

Prior to cementing, the retainer housing space 28 may be filled with encapsulated cement retardant through the grease injection hole 38 (and, optionally, the vent hole 36), so as to at least mitigate ingress of cement during cementing, and also to at least mitigate curing of cement in space that is in proximity to the vent hole 36, or of any cement that has become disposed within the vent hole or the retainer housing space 28. In those embodiments where, while the flow control member 16 is disposed in the open position, fluid communication may become effected, within the wellbore string 11, between the retainer housing space 28 and the passage 13 through a relatively small fluid passage 34 defined between the flow control member 16 and the upper cross-over sub 12B, the encapsulated cement retardant disposed within the retainer housing space 28, in combination with the relatively small flow area provided by the fluid passage 34 established between the upper cross-over sub 12B and the flow control member 16 (while the flow control member 16 is disposed in the open position), at least mitigates the ingress of solids (including debris or proppant) from within the passage 13, and/or from the fluid treatment flow control apparatus port 14, to the retainer housing space 28.

In those embodiments where the wellbore string 11 is cemented to the formation 102, and where each one of the cross-over subs 12B, 12C, independently, includes a sealing member 1211B, 1211C, during cementing, such sealing members may function to prevent ingress of cement into the retainer housing space 28, while the flow control member 16 is disposed in the closed position.

As mentioned above, in some embodiments, both of the opening force and the closing force are imparted by a shifting tool, and the shifting tool is integrated within a downhole tool, such as a bottomhole assembly 100, that includes other functionalities.

Referring to FIGS. 5 to 8, the bottomhole assembly 100 is deployable within the wellbore 104, through the wellbore string passage 2 of the wellbore string 11, on a workstring 800. Suitable workstrings include tubing string, wireline, cable, or other suitable suspension or carriage systems. Suitable tubing strings include jointed pipe, concentric tubing, or coiled tubing. The workstring includes a fluid passage, extending from the surface, and disposed in, or disposable to assume, fluid communication with a passage 2021 of the bottomhole assembly (see below). The deployed tool includes the bottomhole assembly 100 and the workstring 800.

The workstring 800 is coupled to the bottomhole assembly 100 such that forces applied to the workstring 200 are transmitted to the bottomhole assembly 100 to actuate displacement of the flow control member 16.

While the bottomhole assembly 100 is deployed through the wellbore string passage 2 (and, therefore, through the wellbore 104), an intermediate (or annular) region 112 is defined within the wellbore string passage 2 between the bottomhole assembly 100 and the wellbore string 11.

In some embodiments, for example, the bottomhole assembly 100 includes an uphole assembly portion 200, a downhole assembly portion 300, an actuatable sealing member 502, actuatable mechanical slips 504, and a locator 600. The uphole assembly portion 200 includes a housing 201, a passage 202, a perforating device 224, a second shifting tool 220, and a valve plug 210. The downhole assembly portion 300 includes a fluid distributor 301 and a first shifting tool mandrel 320. The passage 202 of the uphole assembly portion 200 is disposed in fluid communication with the fluid distributor via ports 203 disposed within the housing 201.

The fluid distributor 301 includes ports 302 and 304. A valve seat 306 is defined within the fluid distributor, and includes an orifice 308. The valve seat 306 is configured to receive seating of the valve plug 210. While the valve plug 210 is unseated relative to the valve seat 406, fluid communication, via the orifice 308, is effected between the ports 302 and 304. While the valve plug 210 is seated on the valve seat 306, fluid communication between the ports 302 and 304, via the orifice 306, is sealed or substantially sealed.

While: (i) the bottomhole assembly 100 is deployed within the wellbore 104, (ii) the valve plug 210 is unseated relative to the valve seat 306, and (iii) the sealing member 502 is disposed in sealing engagement or substantially sealing engagement with the flow control member 16 (see below), the port 304 effects fluid communication, via the orifice 308, between the uphole wellbore portion 108 (such as, for example, the annular region 112) and the downhole wellbore portion 106.

The valve plug 210 of the uphole assembly portion 200 is configured for sealingly, or substantially sealingly, engaging the valve seat 306 and thereby sealing fluid communication or substantially sealing fluid communication between the uphole and downhole wellbore portions 108, 106 via the orifice 212A. The combination of the valve plug 210 and the fluid distributor 301 define the equalization valve 400.

The equalization valve 400 is provided for at least controlling fluid communication between: (i) an uphole wellbore portion 108 (such as, for example, the annular region 112 between the wellbore string and the bottomhole assembly) that is disposed uphole relative to the sealing member 502, and (ii) a downhole wellbore portion 106 that is disposed downhole relative to the sealing member 502, while the sealing member 502 is actuated and disposed in a sealing, or substantially sealing, relationship with the wellbore string 11 (see below).

In this respect, while the sealing member 502 is sealingly, or substantially sealingly, engaging the wellbore string 11 (see below), the equalization valve 400 is disposable between at least two conditions:

(a) a downhole isolation condition, wherein fluid communication, between the uphole annular region portion 112 and the downhole wellbore portion 106, is sealed or substantially sealed (see FIGS. 5, 6 and 7), and (b) a depressurization condition, wherein the uphole wellbore portion 108 (such as, for example, the annular region 112 between the wellbore string and the bottomhole assembly) is disposed in fluid communication, with the downhole wellbore portion 106 (see FIG. 8), such as, for example, for effecting depressurization of the uphole wellbore portion 108.

While the equalization valve 400 is disposed in the downhole isolation condition, the valve plug 210 is disposed in the downhole isolation position such that the valve plug 210 is disposed in sealing engagement with the valve seat 306 and sealing, or substantially sealing fluid communication between the uphole and downhole wellbore portions 108, 106 via the orifice 308 and the port 304. While the equalization valve 400 is disposed in the depressurization condition, the valve plug 210 is disposed in the depressurization position such that the valve plug 210 is spaced apart from the valve seat 306 such that fluid communication is effected between the uphole and downhole wellbore portions 108, 106 via the orifice 308 and the port 304.

The uphole assembly portion 200, including the valve plug 210, is displaceable relative to the valve seat 306. The uphole assembly portion 200, including the valve plug 210, is connected to and translatable with the workstring 800 such that displaceability of the uphole assembly portion 200 (and, therefore, the valve plug 210), relative to the valve seat 306, in response to forces that are being applied to the workstring 800, between a downhole isolation position, corresponding to disposition of the equalization valve 400 in the downhole isolation condition, and a depressurization position, corresponding to disposition of the equalization valve 400 in the depressurization condition.

The displacement of the valve plug 210 from the depressurization position to the downhole isolation position is in a downhole direction. Such displacement is effected by application of a compressive force to the workstring 800, which is transmitted to the valve plug 210. Downhole displacement of the valve plug 210, relative to the valve seat 306 is limited by the valve seat 306 upon contact engagement between the valve plug 210 and the valve seat 306.

The displacement of the valve plug 210 from the downhole isolation position to the depressurization position is in an uphole direction. Such displacement is effected by application of a tensile force to the workstring 800, which is transmitted to the valve plug 210. Uphole displacement of the valve plug 210 (and, therefore, the uphole assembly portion 200), relative to the valve seat 306, is limited by a shoulder 310 that is defined within the fluid distributor 301. In this respect, the uphole assembly portion 211 includes an engagement surface 211, and the limiting of the uphole displacement of the valve plug 210, relative to the valve seat 306, is effected upon contact engagement between the engagement surface 211 and the shoulder 310.

While the bottomhole assembly 100 is disposed within the wellbore 104 and connected to the workstring 800, the passage 202 is fluidly communicable with the wellhead via the workstring 800 and is also fluidly communicable with the fluid distributor. The passage 202 is provided for, amongst other things, (i) effecting downhole flow of fluid perforating agent to the perforating device 224 for effecting perforation of the wellbore string 11; (ii) effecting downhole flow of fluid for effecting actuation of the hydraulic hold down buttons of the second shifting tool (see below); and (iii) and flushing of the wellbore 8 by uphole flow of material from the uphole annular region 212 and via the port 302 (such flow being initiated by downhole injection of fluid through the uphole annular region 112 while a sealing interface is established for sealing or substantially sealing fluid communication between the uphole and downhole wellbore portions 108, 106, such sealing interface being established, for example, by the combination of at least the sealing engagement or substantially sealing engagement between the sealing member 502 and the wellbore string 11 and the seating of the valve plug 210 on the valve seat 306 and thereby sealing or substantially sealing the orifice 308—see below). In some embodiments, for example, and where a check valve 222 is not provided (see below), the passage 202 could also be used for effecting flow of treatment material to the subterranean formation 102 (by receiving treatment material supplied by the workstring 800, such as, for example, a coiled tubing) via the port 302.

A check valve 222 is disposed within the passage 202, and configured for preventing, or substantially preventing, flow of material in a downhole direction from the surface. The check valve 222 seals fluid communication or substantially seals fluid communication between an uphole portion 202A of the passage 202 and the uphole annular region portion 112 (via the fluid conductor ports 302) by sealingly engaging a valve seat 2221, and is configured to become unseated, to thereby effect fluid communication between the uphole annular region portion 112 and the uphole portion 202A, in response to fluid pressure within the uphole annular region portion 108 exceeding fluid pressure within the uphole portion 202A. In this respect, the check valve 222 permits material to be conducted through the passage 201 in an uphole direction, but not in an downhole direction. In some implementations, for example, and as referred to above, the material being supplied downhole through the annular region 112 includes fluid for effecting reverse circulation (in which case, the above-described sealing interface is established), for purposes of removing debris from the annular region 112, such as after a "screen out", and the check valve permits such reverse circulation. In some embodiment, for example, the check valve 222 is in the form of a ball that is retained within a portion of the passage 201 by a retainer 2223.

The first shifting tool mandrel 320 extends from the fluid distributor 301. In some embodiments, for example, the first shifting tool mandrel 320 further includes a bullnose centralizer 322 for centralizing the bottomhole assembly 100.

Figure 6:
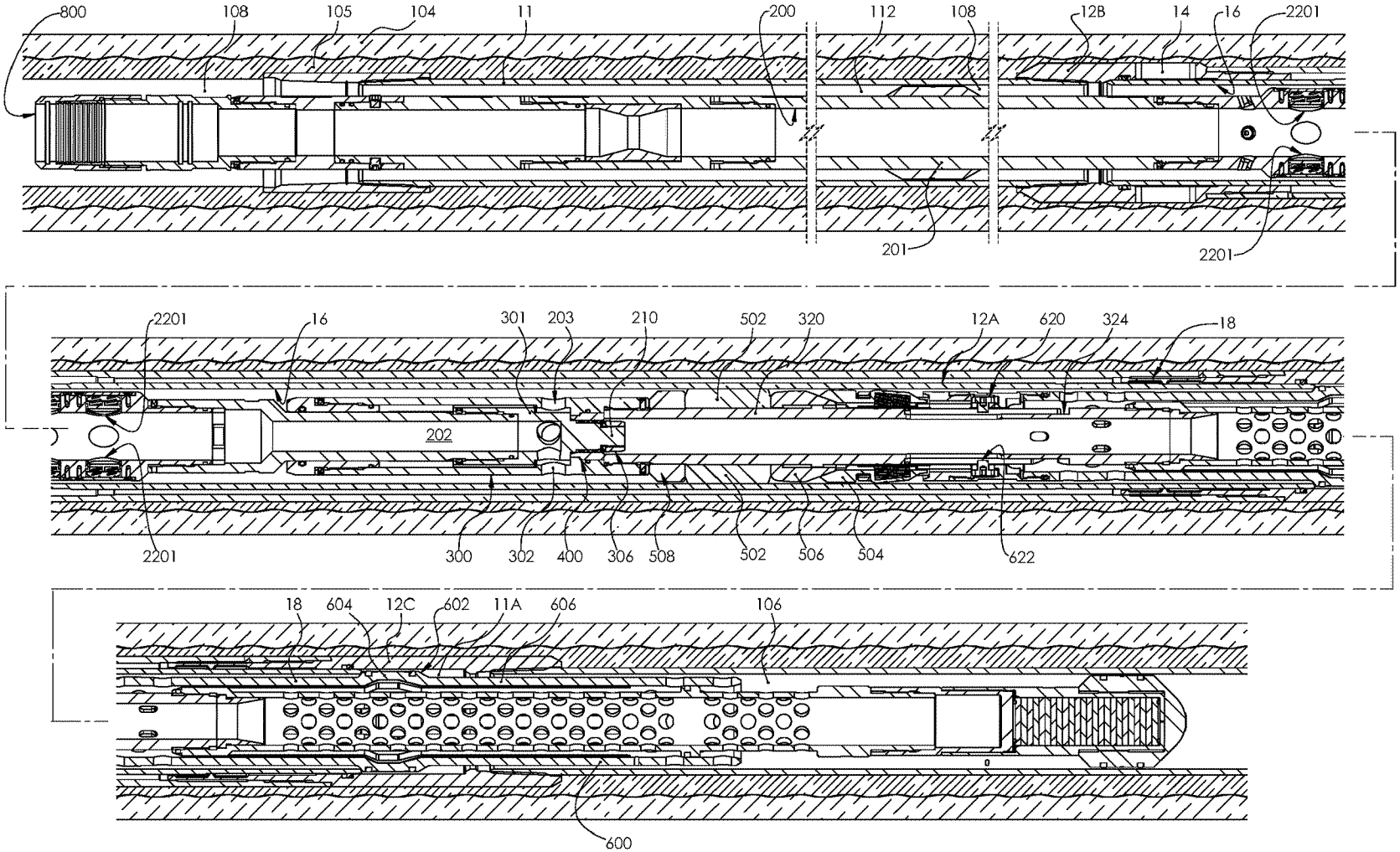
FIG. 6 is a side sectional view of the system shown in FIG. 5, illustrating the bottomhole assembly with the equalization valve plug having been moved further downhole relative to the first position in FIG. 5, and thereby effecting actuation of the first shifting tool and its engagement to the flow control member.
Figure 7:
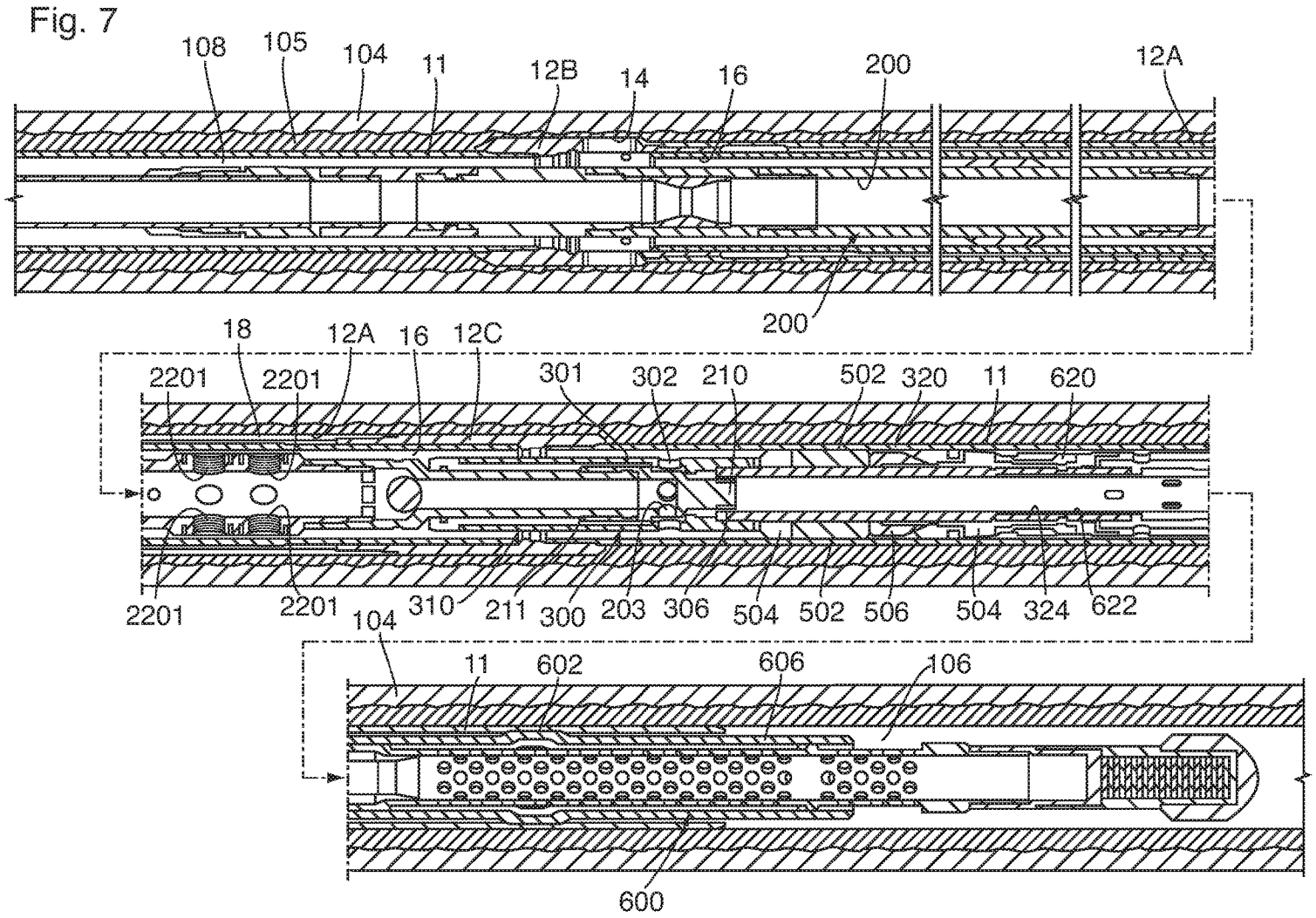
FIG. 7 is a side sectional view of the system shown in FIG. 5, illustrating the bottomhole assembly having effected displacement of the flow control member to the open position in response to displacement of the first shifting tool in a downhole direction.
Figure 8:
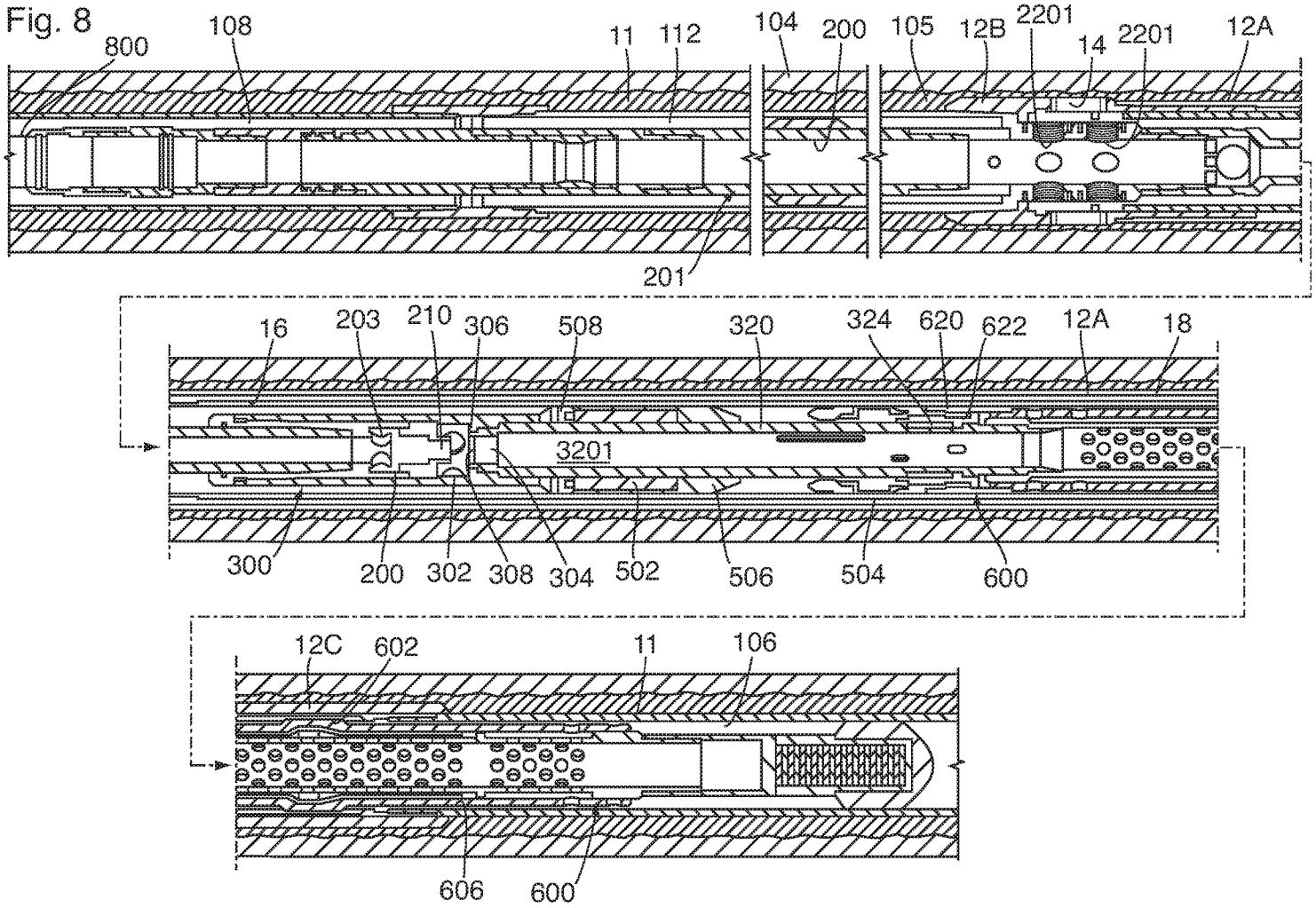
FIG. 8 is a side sectional view of the system shown in FIG. 5, illustrating the bottomhole assembly after completion of fluid treatment and after the equalization valve plug has been moved uphole to effect pressure equalization.

The actuatable sealing member 502 is supported on the first shifting tool mandrel 320 and configured for becoming disposed in sealing engagement with the wellbore string 11, such that, in combination with the sealing, or substantially sealing, engagement between the valve plug 210 and the valve seat 306, the sealing interface is defined between the uphole and wellbore portion 108, 106. The sealing member 502 is configured to be actuated into sealing engagement with the flow control member 16, in proximity to a port 14 that is local to a selected treatment material interval, while the assembly 100 is deployed within the wellbore 104 and has been located within a predetermined position at which fluid treatment is desired to be a delivered to the formation. In this respect, the sealing member 502 is displaceable between at least an unactuated condition (see FIGS. 5 and 8) and a sealing engagement condition (FIGS. 6 and 7). In the unactuated condition, the sealing member 502 is spaced apart (or in a retracted state) relative to the flow control member 16. In the sealing engagement condition, the sealing member 502 is disposed in sealing, or substantially sealing, engagement with the flow control member 16, while the assembly 100 is deployed within the wellbore 104 and has been located within a predetermined position at which fluid treatment is desired to be a delivered to the formation 102. The sealing engagement is with effect that fluid communication through the annular region 112, between the first shifting tool mandrel 320 and the wellbore string 11, and between the treatment material interval and a downhole wellbore portion 106, is sealed or substantially sealed. In some embodiments, for example, the sealing member 502 includes a packer.

The locator 600 is disposed about the first shifting tool mandrel 320 and includes an engagement feature 602 (such as, for example, a protuberance (i.e. locator protuberance), such as a locator block 602, for releasably engaging a locate profile 11A within the wellbore string 11. The releasable engagement is such that relative displacement between the locator 600 and the locate profile 11A is resisted. In some embodiments, for example, the resistance is such that the locating mandrel 600 is releasable from the locate profile 602 in response to the application of a minimum predetermined force, such as a force transmitted from the workstring 800 (see below). In some embodiments, for example, the locator 600 is in the form of a mandrel.

In some embodiments, for example, the locator 600 includes a collet 604, with the locator block 602 attached to the collet 604. In some embodiments, for example, the collet 604 includes one or more collet springs 606 (such as beam springs) that are separated by slots. In some contexts, the collet springs 606 may be referred to as collet fingers. In some embodiments, for example, a locator block 602 is disposed on each one of one or more of the collet springs 606. In some embodiments, for example, the locator block 602 is defined as a protuberance on the collet spring 606.

In some embodiments, for example, the collet springs 606 are configured for a limited amount of radial compression in response to a radially compressive force. In some embodiments, for example, the collet springs 606 are configured for a limited amount of radial expansion in response to a radially expansive force. Such compression and expansion enable the collet springs 606 to pass by a restriction in a wellbore 104 while returning to its original shape, while still exerting some drag force against the wellbore string 11 and, in this way, opposing the travel of the bottom hole assembly 100 through the wellbore 104.

In this respect, in some embodiments, for example, the collet springs 606 exerts a biasing force such that, when the locator block 602 becomes positioned in alignment with the locate profile 11A, the resiliency of the collet springs urges the locator block 602 into disposition within the locate profile, thereby "locating" the bottomhole assembly 100. While the locator block 602 is releasably engaged to the locate profile 11A, the biasing force is urging the locator block 602 into the releasable engagement.

Figure 10:
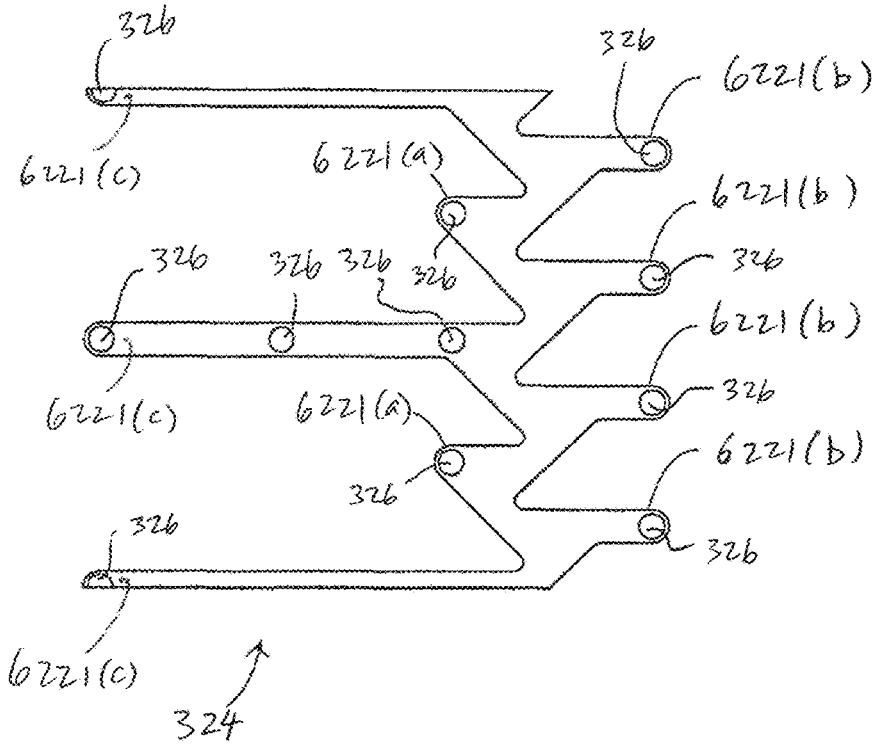
FIG. 10 is a schematic illustration of a j-slot of the bottomhole assembly illustrated in FIGS. 5 to 8.

The locator 600 is coupled to a clutch ring 620. The clutch ring 620 is rotationally independent from the locator 600 and translates axially with the locator 600. A cam actuator or pin 622 extends from the clutch ring, and is disposed for travel within a j-slot 324 (see FIG. 10) formed within the first shifting tool mandrel 320, such that coupling of the locator 600 to the first shifting tool mandrel 320 is effected by the disposition of the pin 622 within the j-slot 324. The coupling of the locator 600 to the first shifting tool mandrel 320 is such that relative displacement between the locating mandrel 300 and the first shifting tool mandrel 320 is guided by interaction between the pin 622 and the j-slot 324. The pin 622 is positionable at various positions within the j-slot 324. Pin position 6221(*a*) corresponds to a run-in-hole ((("RIH") mode of the bottomhole assembly 100. Pin position 6221(*b*) corresponds to a pull-out-of-hole ((("POOH") mode of the bottomhole assembly 100. Pin position 6221(*c*) corresponds to the set mode of the bottomhole assembly 100, wherein the packer is disposed in the set condition. Debris relief apertures 326 may be provided at various positions within the j-slot 324 to permit discharge of settled solids as the pin slides within the j-slot 324.

The actuatable mechanical slips are slidably mounted to and supported on the first shifting tool mandrel 320. The slips 504 are rotatable relative to the mandrel such that rotation effects displacement of a gripping surface away (such as, for example, radially) relative to the mandrel 320, such that the slips 504 become actuated. The actuatable slips are biased (such as, for example, by a spring) to a retracted position relative to the mandrel 320.

The actuatable mechanical slips 504 are actuatable from a retracted position, wherein the slips 504 are disposed in a spaced apart relationship relative to the wellbore string (such as, for example, the flow control member 16) to an actuated position, wherein the slips 504 are engaged to (such as, for example, gripping or "biting into") the wellbore string (such as, for example, the flow control member 16), by the setting cone 506. By engaging the flow control member 16, the mechanical slips 504 are disposed for transmitting a force to the flow control member 16 for effecting displacement of the flow control member 16. The setting cone is slidably mounted over and supported by the mandrel 320. The setting cone 506 is displaceable downhole in response to application of a compressive force to the workstring 800, that is transmitted by the fluid distributor 301 (via the sealing member 502, see below) to the setting cone 506, via the seating of the valve plug 210 on the valve seat 306. The slips 504 are disposed relative to the locator 600 such that, during the displacement of the setting cone 506 relative to the locator 600 in a downhole direction, engagement of the slips 504 by the cone 506 effects displacement (in some embodiments, for example, the displacement includes a rotation) of the slips 504 such that the gripping surface is displaced away (e.g. radially) relative to the mandrel 320 from a first gripper surface-retracted position to a first gripping surface-actuated position. In this respect, actuation of the slips 504 is thereby effected by the setting cone 506.

The downhole assembly portion 300 is configured to receive compressive forces applied to the workstring when the valve plug 210 is seated on the valve seat 306, such that the downhole wellbore portion is displaceable downhole in response to the receiving of the compressive forces. In this respect, such compressive forces are transmitted to the valve seat 306 by the valve plug 210 when the valve plug 210 is seated on the valve seat 306.

The downhole assembly portion 300 is also configured to receive tensile forces applied to the workstring (e.g. pulling up forces) when the engagement surface 211 is disposed in contact engagement with the shoulder 310 of the fluid distributor 300, such that the downhole wellbore portion 300 is displaceable uphole in response to the receiving of the tensile forces. In this respect, such tensile forces are transmitted to the shoulder 310 by the engagement surface 211 when the engagement surface 211 is disposed in contact engagement with the shoulder 310.

The actuation of the mechanical slips 504 is effected by a compressive force exerted on the workstring 800 and transmitted by a setting cone 506 to the mechanical slips 504 while the bottomhole assembly 100 is located within the wellbore 104 (i.e. the locator block 602 is disposed within the locate profile 11A), and while the first shifting tool mandrel 320 is displaceable relative to the locator 700. The setting cone 506 is supported on the first shifting tool mandrel 320 and is disposed downhole relative to the sealing member 502. Because the mechanical slips 504 are coupled to the locator 700, and because displacement of the locator 700, relative to the wellbore string 11 is resisted by virtue of the releasable engagement of the locator block to the locate profile 11A, in response to the compressive force applied to the workstring 800, the downhole assembly portion 300 is displaceable downhole, relative to the mechanical slips 502, by the transmission of the applied compressive force by the valve plug 210 to the valve seat 306. The fluid distributor 301 includes a force transmission surface that is disposed to transmit an axial force to the sealing member 502 (such as, in some embodiments, for example, a gauge ring 508 that is also supported on the first shifting tool mandrel 320) such that the sealing member 502 is also displaceable downhole relative to the mechanical slips in response to the application of the compressive force to the workstring 800.

Similarly, the sealing member 502 includes a force transmission surface that is disposed to transmit the axial force to the slips 504 in a downhole direction such that the slips are translatable downhole with the downhole assembly portion 300 and the sealing member 502, with effect that the setting cone 506 is also displaceable downhole relative to the slips 504 in response to the application of the compressive force to the workstring 800. In this respect, the setting cone 506 is displaceable downhole relative to the slips 504, by a compressive force being applied to the workstring 800, so as to become disposed in force transmission communication (for example, contact engagement) with the slips 504, and thereby transmit the applied compressive force to the slips 504 and, consequently, to the locator 600. Because the locator block 602 is disposed within the locate profile 11A and resisting downhole displacement, in response to the transmission of the applied compressive force by the cone 506, a reaction force is transmissible by the locator 600 to the slips 504. As a result, the slips 504 are disposed for to rotation into a gripping engagement disposition to the flow control member 16 as the setting cone 506 is driven into the slips such that the slips are gripping (or "biting into") the flow control member 16, and, in this respect, have become actuated.

As well, the sealing member 502 is compressible between the slips 504 and the fluid distributor 301, as the setting cone 506 is driving into the slips 504 while the locator block is releasably engaged within the locate profile 11A (and thereby transmitting the compressive force, being applied to the workstring 800, to the slips 504 and receiving the reaction force exerted by the locator 600 via the slips 504), such that the sealing member 502 becomes deformed and with effect that the sealing member 502 becomes disposed in sealing, or substantially sealing, engagement with the flow control member 16. At least the combination of the disposition of the sealing member in sealing engagement or substantially sealing engagement with the flow control member, and the seating of the valve plug 210 on the valve seat 306, establishes the sealing interface. In such disposition, the sealing member 502 is disposed in a set condition.

In some embodiments, for example, the mechanical slips 504 define a first shifting tool 510. In some embodiments, for example, at least the combination of the mechanical slips 504 and the sealing member 502 define the first shifting tool 510. In this respect, in some embodiments, for example, the engagement of the sealing member 502 to the flow control member 16 is such that, during the displacement of the first shifting tool mandrel 320 relative to the locator 600, the sealing member 502 transmits at least some of the compressive forces, being applied to the workstring 800, in the form of a frictional force, thereby contributing to the force effecting the displacement of the flow control member 16, and thereby qualifying as being part of the first shifting tool 510. The first shifting tool 510 is configured for effecting opening of the flow control member 16, in response to application of a force to the shifting tool 510 that is sufficient to overcome the resistance being provided by the resilient retainer member 18 (such force, for example, can be applied hydraulically, mechanically (such as by the workstring), or a combination thereof). In some embodiments, for example, once the sealing interface is established, and with the valve plug 210 disposed in the downhole isolation position, the wellbore can be pressurized uphole of the seal, establishing a pressure differential across the seal, and thereby applying a force that is transmitted by the shifting tool 510 to the flow control member 16, thereby effecting displacement of the flow control member 16 from the closed position to an open position such that the port becomes opened for effecting supplying of treatment fluid to the subterranean formation (see FIG. 7).

While the sealing member 502 is disposed in the sealing engagement condition and while the valve plug 210 is disposed in the downhole isolation position, such that the sealing interface has been established, and while the flow control member 16 is disposed in the open position (see FIG. 7), treatment material may be supplied downhole and directed to the port 14 (and through the port 14 to the treatment interval) through the uphole annular region portion 108 of the wellbore string passage 2. Without the valve plug 210 effecting the sealing of fluid communication, via the orifice 308, between the uphole annular region portion 108 and the downhole wellbore portion 106 (by being disposed in the downhole isolation position), at least some of the supplied treatment material would otherwise bypass the port 14 and be conducted further downhole from the port 14 via fluid conductor ports 302 to the downhole wellbore portion 106. Also, the check valve 222 prevents, or substantially prevents, fluid communication of treatment material, being supplied downhole through the uphole annular region portion 108, with the uphole passage portion 201A, thereby also mitigating losses of treatment material uphole via the passage 201.

Figure 9:
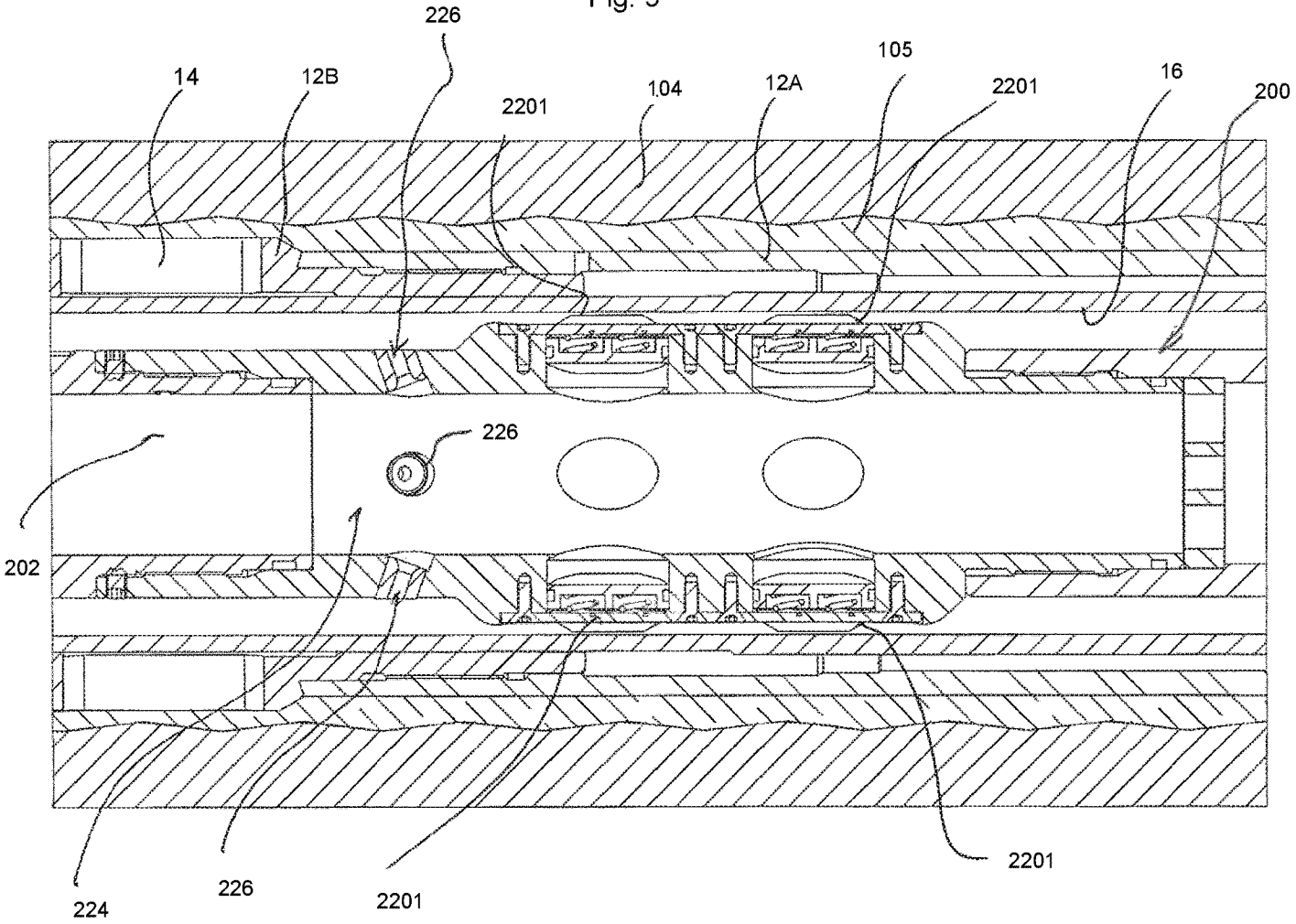
FIG. 9 is a detailed side sectional view of the system shown in FIG. 8, illustrating a portion of the bottomhole assembly with the flow control member having been moved to the closed position by the hydraulic hold down buttons.

The second shifting tool 520 is provided for effecting displacement of the flow control member 16 from the open condition to the closed condition. The second shifting tool 220 includes one or more hydraulic hold down buttons 2201. In some embodiments, for example, the one or more hydraulic hold down buttons 2201 are disposed uphole relative to the valve plug 210 and mounted to the housing 201 such that the hydraulic hold down buttons 2201 are disposed in fluid communication with the passage 202. The one or more hydraulic hold down buttons 2201 are configured to be actuated (see FIG. 9) for exerting a sufficient gripping force against the flow control member 16, while the flow control member 16 is disposed in the closed position, such that, while the flow control member 16 is disposed in the closed position, and while the hydraulic hold down buttons 2201 are actuated, and while a pulling up force is being applied by the workstring 800, displacement of the flow control member 16 from the open position to the closed position is effected. The one or more hydraulic hold down buttons 2201 are actuated when the pressure within the passage 202 exceeds the pressure within the annular region 112. In some embodiments, for example, the fluid pressure differential may be established by supplying pressurized fluid through the passage 202 from a source at the surface. While the fluid is being supplied through passage 202 for effecting the actuation of the hydraulic hold down buttons 2201, the check valve 222 is urged to a closed condition, thereby forcing the supplied fluid to be used to establish the pressure differential required for the actuation (such as, for example, forcing the supplied fluid to be conducted through the nozzles 226 of the perforating device 224—see below).

The uphole assembly portion 200 further includes the perforating device 224. The perforating device 224 is mounted to the housing 201 such that the perforating device 224 is disposed in fluid communication with the passage 202 for receiving fluid perforating agent from surface via the passage 2021 and jetting the received fluid perforating agent (through the nozzles 226 of the perforating device 224) against the wellbore string 11 for effecting perforation of the portion of the wellbore string 11 adjacent to the nozzles 226. The fluid perforating agent includes an abrasive fluid. In some of these embodiments, for example, the abrasive fluid includes a carrier fluid and an abrasive agent, and the abrasive agent includes sand. In some embodiments, for example, the carrier fluids includes one or more of: water, hydrocarbon-based fluids, propane, carbon dioxide, and nitrogen assisted water. It is understood that use of the perforating device to effect perforating, in this context, is generally limited to upset conditions where the flow control member 16 is unable to be moved by the second shifting tool 520 from the closed position to the open position. In those circumstances, perforation may be necessary in order to effect supply of treatment material to the treatment material interval in the vicinity of the selected flow control apparatus port 14. While the fluid perforating agent is being supplied through passage 202, the check valve 222 is urged to a closed condition, thereby forcing the supplied fluid perforating agent to be conducted through the nozzles 226.

In some embodiments, for example, the perforating device 224 is disposed uphole relative to the one or more hydraulic hold down buttons 2201, and provides the additional functionality of enabling their actuation through the jetting of fluid through one or more of its nozzles 226, as is explained further below. While fluid is being supplied via the passage 202, the check valve 222 is urged to a closed condition, thereby forcing the supplied fluid to be directed through the nozzles 226, and thereby effecting the actuation of the hydraulic hold down buttons 2201.

In combination with enabling actuation of the hydraulic hold down buttons 2201, the jetting of fluid through its nozzles 226 may also perform a "washing" or "flushing" function (and thereby functions as a "washing sub"), in that at least a fraction of solid material disposed in the vicinity of the flow control apparatus port 14 is fluidized, carried, or swept away, by the injected fluid remotely from the flow control apparatus port 14. While the flow control member 16 is disposed in the open position, solid material in the vicinity of the port 14 may interfere with displacement of the flow control member 16 from the open position to the closed position. Solid material that may be present in the vicinity of the flow control apparatus port includes sand which has migrated in through the port 14 from the formation 102 during supplying of the treatment material through the port 14, or after the supplying has been suspended. The solid material can include proppant which is remaining within the wellbore. By removing such solid material from the vicinity of the flow control apparatus port, prior to, or while, moving of the flow control member 16 to the closed position, interference to such closure may be mitigated.

In this respect, the nozzles 226 are configured to inject fluid into the wellbore 104, and positioned relative to the hydraulic hold down buttons 2201, such that, while the apparatus 10 is positioned within the wellbore 104 such that, upon the actuation of the second shifting tool (e.g. the hydraulic hold down buttons 2201), the engagement between the second shifting tool and the flow control member 16 is being effected, and while the flow control member 16 is disposed in the open position, the nozzles 226 are disposed for directing injected fluid towards the path along which the flow control member 16 is disposed for travelling as the flow control member 16 is displaced from the open position to the closed position.

In some embodiments, for example, the nozzles 226 are further co-operatively positioned relative to the hydraulic hold down buttons 2201 such that, while the flow control member 16 is disposed in the open position, and the nozzles 226 are jetting fluid to actuate the hydraulic hold down buttons 2201 (see below) and clearing solid debris from the port 14, the nozzles are directed such that the fluid is jetted in a direction that is not in alignment with sealing members that are exposed within the passage 13 (e.g. sealing member 121B or sealing member 121C) so as to avoid damaging or displacing the sealing member (such as by displacing the sealing member from the cavity within which it is disposed)

In some embodiments, for example, independently of any perforating device 224, a washing sub may be provided to effect the washing/flushing function that is described above. In some embodiments, for example, the washing sub is configured to discharge or jet fluid characterized by a flowrate of between 20 and 1,500 liters per minute and at a pressure differential of between 20 and 200 pounds per square inch.

The following describes an exemplary deployment of the bottomhole assembly 100 within a wellbore 104 within which the above-described apparatus is disposed, and subsequent supply of treatment material to a zone of the subterranean formation 102.

The bottomhole assembly 100 is run downhole through the wellbore string passage 2, past a predetermined position (based on the length of workstring 800 that has been run downhole). The j-slot 324 is configured such that, while the assembly 100 is being run downhole, displacement of the first shifting tool mandrel 320 relative to the locator 600 is limited such that the setting cone 506 is maintained in spaced apart relationship relative to the mechanical slips 504, such that the mechanical slips 504 are not actuated during this operation. In this respect, while the bottomhole assembly is being run downhole through the wellbore string passage 2, the pin 62 is positioned in pin position 6223(*a*) within the j-slot 324. Once past the desired location, a tensile force (such as, for example, a pulling up force) is applied to the workstring 800, and the predetermined position, at which the selected flow control apparatus port 14 is located, is located with the locator block 602. The bottom hole assembly becomes properly located when the locator block 602 becomes disposed within the locate profile 11A within the wellbore string 11. In this respect, the locator block 602 and the locate profile 11A are co-operatively profiled such that the locator block 602 is configured for disposition within and releasable engagement to the locate profile 11A when the locator block 602 becomes aligned with the locate profile 11A. Successful locating of the locator block 602 within the locate profile 11A is confirmed when resistance is sensed in response to upward pulling on the workstring 800. During the pulling up on the workstring, the pin 622 is displaced to pin position 6221(*b*) within the j-slot 324.

Figure 5:
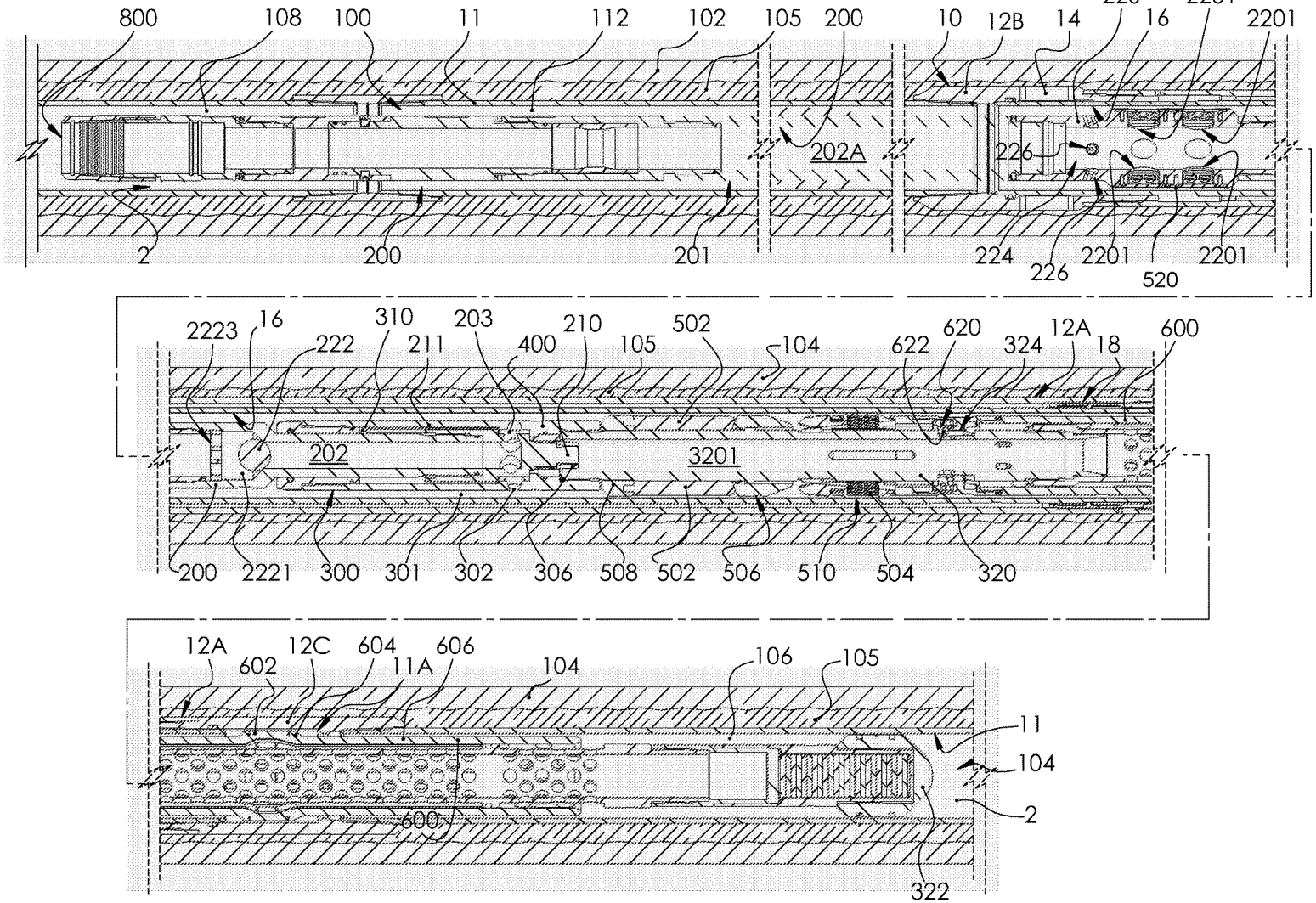
FIG. 5 is a side sectional view of an embodiment of a system of the present disclosure, incorporating the flow control apparatus of FIG. 1 within a wellbore string disposed within a wellbore, and illustrating a bottomhole assembly having been located within a pre-selected position within the wellbore, with the flow control member disposed in the closed position, and with the equalization valve plug disposed in the downhole isolation condition, but prior to actuation of the first shifting tool and its engagement to the flow control member.

Once disposed in the pre-determined position, and after pulling up on the workstring 800 to confirm the positioning, the workstring 800 is forced downwardly, and the applied force is translated such that sealing engagement of the valve plug 210 with the valve seat 306 is effected (see FIG. 5). Further compression of the workstring 800 results in the actuation of the mechanical slips 504 for effecting gripping of the flow control member 16 by the mechanical slips 504. As well, the compression effects actuation of the sealing member 502 (as the first shifting tool mandrel 320 receives the compressive forces imparted by the workstring 800), for effecting engagement of the sealing member 502 to the flow control member 16 (see FIG. 6). The seating of the valve plug 210 on the valve seat 306, in combination with the actuation of the sealing member, creates the sealing interface. While the workstring 800 continues to be disposed in compression, a pressurized fluid is supplied uphole of the sealing interface from the surface, such as via the annular region 112, with effect that a pressure differential is established across the sealing interface such that shearing of the one or more shear pins 40 is effected, the one or more tabs 18B become displaced out of the closed position-defining recess 30 of the flow control member 16 (such as by deflection of the tabs 18B), and the flow control member 16 is displaced from the closed position to the open position (by the force transmitted by the first shifting tool 510), thereby effecting opening of the port 14 and enabling supply of treatment material to the subterranean formation 102 that is local to the flow control apparatus port 14 (see FIG. 7). In parallel, the locator block 602 is displaced from the locate profile 11A, Upon the flow control member 16 being displaced into the open position, the one or more tabs 18B become disposed within the open position-defining recess 32 of the flow control member 16, thereby resisting return of the flow control member 16 to the closed position. During this operation, the pin 622 is displaced to the pin position 6221(*c*) within the j-slot 324.

Treatment material may then be supplied via the annular region 112 defined between the bottomhole assembly 100 and the wellbore string 11 to the open port 14, effecting treatment of the subterranean formation 102 that is local to the flow control apparatus port 14. The sealing member, in combination with the sealing engagement of the valve plug 210 with the valve seat 306 (i.e. the sealing interface) prevents, or substantially prevents, the supplied treatment material from being conducted downhole, with effect that all, or substantially all, of the supplied treatment material, being conducted via the annular region 112, is directed to the formation 102 through the open port 14.

Alternatively, using other embodiments of the bottomhole assembly 100 (i.e. those without the check valve 222), the treatment material may be supplied downhole via coiled tubing, and through the passage 202 to effect treatment of the treatment interval via the flow control apparatus port 14, so long as the sealing member 502 is disposed in the sealing engagement condition, the valve plug 210 is disposed in the downhole isolation position, and the flow control member 16 is disposed in the open position (see FIG. 7).

After sufficient treatment material has been supplied to the subterranean formation 102, supplying of the treatment material is suspended.

In some implementations, for example, after the supplying of the treatment material has been suspended, the flow control member 16 may be returned to the closed position.

In that case, in some of these implementations, for example, prior to effecting displacement of the flow control member 16 from the open position to the closed position with the second shifting tool (i.e. the one or more hydraulic hold down buttons), it may be desirable to depressurize the wellbore uphole of the sealing member 502. In this respect, after the delivery of the treatment material to the formation 102 has been completed, a fluid pressure differential exists across the actuated sealing member (which is disposed in sealing engagement with the flow control member 16), owing to the disposition of the equalization valve 500 in the downhole isolation condition. This is because, when disposed in the downhole isolation condition, the valve plug 210 prevents, or substantially prevents, draining of fluid that remains disposed uphole of the sealing member 502. Such remaining fluid may provide sufficient interference to movement of the flow control member 16 from the open position to the closed position, such that it is desirable to reduce or eliminate the fluid remaining within the annular region 112 and the formation, and thereby reduce or eliminate the pressure differential that has been created across the sealing member, prior to effecting the displacement of the flow control member 16 from the open position to the closed position.

In some of these embodiments, for example, the reduction or elimination of this pressure differential is effected by retraction of the valve plug 210 from the valve seat 306, by pulling uphole on the workstring 800, to thereby effect draining of fluid, disposed uphole of the sealing member 502, in a downhole direction to the downhole wellbore portion 106, via the port 304 and the passage 3201 of the first shifting tool mandrel 320. In response to the reduction or elimination in the pressure differential, the force urging the sealing member 502 into the engagement with the flow control member 16 is removed or reduced such that the sealing member 502 retracts from the flow control member 16. In parallel, the pin 622 is displaced within the j-slot 324 to the pin position 6221(*b*).

The workstring 800 continues to be pulled upwardly such that the engagement surface 211 becomes disposed against the shoulder 310, such that the force is transmitted to the downhole assembly portion 300 via the shoulder 310, effecting displacement of the downhole assembly portion 300, including the first shifting tool mandrel 320, such that the setting cone 506 becomes spaced apart from the mechanical slips 504, as displacement of the mechanical slips 504 is restricted by frictional drag of the locator 600 versus the wellbore string 11, resulting in retraction of the slips 504 from the flow control member 16, owing to the bias of the mechanical slips 504.

Because the mechanical slips 504 and the sealing member 502 have become retracted from the flow control member 16, the first shifting tool 510 is no longer functional for effecting displacement of the flow control member 16 in the uphole direction for effecting closure of the port 14. In this respect, in these embodiments, the second shifting tool 220 is provided for effecting this displacement. As described above, the second shifting tool 220 includes hydraulic hold down buttons 2201. The hydraulic hold down buttons 2201 are then actuated for gripping (or "biting into") the flow control member 16 with effect that tensile force (such as, for example, a pulling up force) imparted to the hydraulic hold down buttons 2201, via the workstring 200, may be translated as the closing force to the flow control member 16 by the hydraulic hold down buttons 2201. Actuation of the hydraulic hold down buttons 2201 is effected by supplying fluid (for example, such as water) downhole through the fluid passage 202. As described above, their actuation may be enabled through the jetting of fluid through one or more of the nozzles 226 of the perforating device 224. By virtue of the flow of the fluid through the nozzles 226, a pressure differential is created across the perforating device 226, and this fluid pressure differential actuates the hydraulic hold down buttons 2201. Accordingly, after the retraction of the mechanical slips 504 and the sealing member 502, fluid (such as water) is supplied through the fluid passage 202, resulting in a pressure differential being created across the perforating device 224, and thereby effecting actuation of the hydraulic hold down buttons 2201, so that the hydraulic hold down buttons 2201 are gripping (or "biting into") the flow control member 16.

In some embodiments, for example, after the retraction of the mechanical slips 504 and the sealing member 502, but prior to the actuation of the hydraulic hold down buttons 2201, the hydraulic hold down buttons 2201 must be displaced downhole in order to effect their alignment with the flow control member 16. This is because, in some cases (such as the embodiment illustrated in FIG. 8, in effecting pressure equalization by retracting the valve plug 210 from the valve seat 306, the hydraulic hold down buttons 2201 may have become displaced uphole of the flow control member 16.

In parallel with the actuation of the hydraulic hold down buttons 2201, the supplied fluid also functions to fluidize or displace solid material from the vicinity of the path along which the flow control member 16 is disposed for travelling as the flow control member 16 moves between the open position and the closed position.

Once the hydraulic hold down buttons 2201 have been actuated and become disposed in gripping engagement with the flow control member 16, a tensile force (such as, for example, a pulling up force) is applied to the workstring 30. By virtue of their engagement to the flow control member 16, the hydraulic hold down buttons 2201 translate the tensile force, being applied by the workstring, as a closing force to the flow control member 16, to effect displacement of the finger tab 18B from (or out of) the open position-defining recess 32. After such displacement, continued application of the tensile force effects displacement of the flow control member 16 from the open position to the closed position.

In some implementations, for example, and as discussed above, effecting pressure equalization prior to the actuation of the hydraulic hold down buttons 2201 may create delays in closing of the valve closure member 16. This is because, during the pressure equalization, the hydraulic hold down buttons 2201 may have become displaced uphole of the flow control member 16 by an indeterminate distance. As a result, additional time may be required to re-position the bottom hole assembly 100 such that the hydraulic hold down buttons 2201 are disposed in alignment with the flow control member 16.

Accordingly, in some implementations, for example, to mitigate such delays, the actuation of the hydraulic hold down buttons is effected prior to effecting pressure equalization. In this respect, in some implementations, for example, after the treatment material has been supplied to the formation through the port 14, and while the flow control member 16 is disposed in the open position, and while the equalization valve 500 is disposed in the downhole isolation condition, liquid is pumped through the passage 202, effecting a first pressure differential across the hydraulic hold down buttons 2201 and thereby effecting actuation of the hydraulic hold down buttons 2201 (as is explained above) such that the hydraulic hold down buttons are now exerting a first gripping force against the flow control member 16, and thereby gripping the flow control member 16 with a relatively strong force. While liquid is being supplied through the passage 202 to maintain the hydraulic hold down buttons 2201 in an actuated state, tensile force is then applied the workstring 800. Because the workstring 800 is sufficiently elastic, and because the bottom hole assembly is fixed, or substantially fixed, relative to the wellbore string 11, the application of the tensile force to the workstring 800 effects elongation of the workstring 800 such that the workstring 800 becomes disposed in tension. After the workstring 800 has been disposed in tension, the pressure differential that is actuating the hydraulic hold down buttons 2201 is reduced to a second pressure differential such that the force being applied by the hydraulic hold down buttons 2201 to the valve closure member 16 is reduced to a second gripping force. The second gripping force is sufficiently low such that, while the second pressure differential is being applied, the tension in the workstring 800 is sufficient to effect uphole displacement of the hydraulic hold down buttons 2201 relative to the flow control member 16 (such as, for example, by sliding the hydraulic hold down buttons 2201 across the flow control member 16) such that the upper assembly portion 200 is displaced uphole relative to the bottom assembly portion 300 such that the valve plug 210 becomes unseated relative to the valve seat 306, such that the uphole wellbore portion 108 becomes disposed in fluid communication with the downhole wellbore portion 106 with effect that the sealing member 502 becomes retracted from the flow control member 16, and such that the engagement surface 211 engages the shoulder 310 with effect that the downhole assembly portion 300 translates uphole with the uphole assembly portion 200 such that the mechanical slips 504 become retracted, but is insufficient to effect displacement of the hydraulic hold down buttons 2201 such that the hydraulic hold down buttons 2201 become disposed uphole relative to the flow control member 16, such that the hydraulic hold down buttons 2201 remain disposed in engagement the flow control member 16. As a result, the uphole wellbore portion 108 becomes disposed in fluid communication with the downhole wellbore portion 106, effecting pressure equalization, and resulting in retraction of the sealing member 502 from the flow control member 16, while the hydraulic hold down buttons 2201 continue to exert the second gripping force against the flow control member 16 and are pulled uphole such that displacement of the flow control member 16 to the closed position is effected.

Alternatively, in order to mitigate the above-described delays, in other implementations, for example, after the displacing of the flow control member 16 such that the opening of the port 14 is effected, sufficient time is elapsed prior to the closing of the port 14 by the second shifting tool 520 such that fluid, that is disposed uphole of the sealing interface, is imbibed into the formation 104 via the opened port 14 such that the reduction of the pressure differential across the sealing interface is effected by at least the imbibition. In some embodiments, for example, the reduced pressure differential, that is existing across the sealing interface, when the uphole force is applied to the workstring 800 for effecting the closing of the port 14 by the second shifting tool 520, is an instantaneous shut-in pressure.

As a further alternative, in other implementation, for example, in order to effect a reduction in the pressure differential, after the opening of the port 14, fluid from uphole of the sealing interface is bled to the surface such that a reduced pressure differential is established across the sealing interface, and the uphole force is applied to the workstring 800, for effecting the closing of the port 14 by the second shifting tool 520, after the reduced pressure differential is established.

Figure 11A:
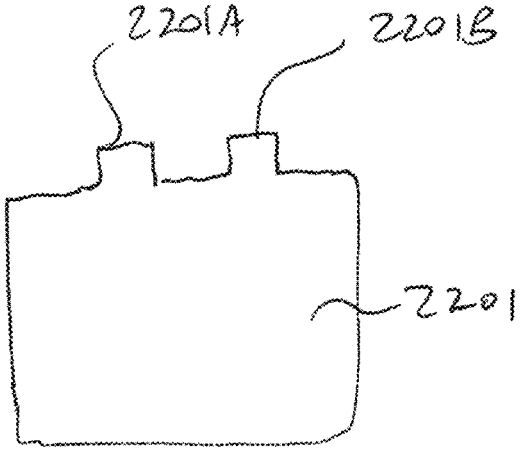
FIGS. 11A and 11B are schematic illustrations of hydraulic hold down button that are integratable within the bottom hole assembly of the system illustrated in FIGS. 5 to 8.
Figure 11B:
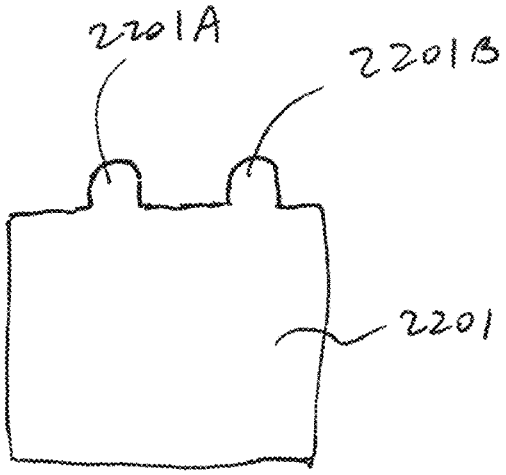

FIGS. 11A and 11B illustrates an exemplary embodiment of a hydraulic hold down button 2201. The hydraulic hold down button includes carbide buttons 2201A, 2201B having a flat surface (see FIG. 11A) or a dome-shaped surface (see FIG. 11B) for engaging the flow closure member 16. By configuring the carbide buttons in this way, the carbide buttons 2201A, 2201B are less likely to bite into the flow control member 16, which would render it more difficult to displace the hydraulic hold down buttons 2201 relative to the flow control member 16 by pulling up on the workstring 800.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A method of stimulating a formation within a wellbore that is lined with a wellbore string, the wellbore string including a port and a flow control member, wherein the flow control member is displaceable relative to the port for effecting opening and closing of the port, comprising:

deploying a workstring including a bottomhole assembly within the wellbore string, wherein the bottomhole assembly includes:

an uphole assembly portion including a valve plug and an actuatable second shifting tool;

a downhole assembly portion including a valve seat and an actuatable first shifting tool;

actuating the first shifting tool such that the first shifting tool becomes disposed in gripping engagement with the flow control member;

establishing a first sealing interface, wherein the sealing interface is effected, at least in part, by:

(a) seating of the valve plug on the valve seat;

(b) sealing engagement or substantially sealing engagement between an actuated sealing element and the flow control member; and applying a displacement-urging pressure differential across the sealing interface by supplying of pressurized fluid uphole of the sealing interface such that, in response, the actuated first shifting tool urges displacement of the flow control member in a downhole direction such that the opening of the port is effected by the displacement;

after the displacing of the flow control member from the closed position to the open position, and while the port is opened, and the pressure differential is existing across the sealing interface, applying a first actuating pressure differential uphole of the sealing interface such that the second shifting tool is actuated and becomes disposed in engagement with the flow control member such that the second shifting tool is exerting a first gripping force against the flow control member;

while the first actuating pressure differential is being applied, applying a tensile force to the workstring that is (i) insufficient to effect displacement of the flow control member relative to the port such that the port becomes closed, and (ii) with effect that the workstring becomes disposed in tension;

reducing the first actuating pressure differential being applied such that a second actuating pressure differential, less than the first actuating pressure differential, is being applied such that the second shifting tool is exerting a second gripping force, less than the first gripping force, against the flow control member;

wherein:

the second gripping force is sufficiently low such that, while the second gripping force is being exerted, the tension in the workstring is sufficient to effect uphole displacement of the second shifting tool relative to the flow control member such that the upper assembly portion is displaced uphole relative to the bottom assembly portion such that the valve plug becomes unseated relative to the valve seat such that the sealing interface is defeated and such that the fluid pressure, resisting uphole displacement of the flow control member, is at least reduced;

the uphole displacement is insufficient to effect displacement of the second shifting tool uphole of the flow control member such that the second shifting tool remains engaged to the flow control member;

and after the sealing interface has been defeated, and while the second shifting tool is exerting the gripping force against the flow control member that is sufficient to effect displacement of the flow control member to the closed position in response to pulling up of the second shifting tool by the workstring, applying a pulling up force to the workstring such that displacement of the flow control member to the closed position is effected.

2. The method as claimed in claim 1, further comprising:

after the opening of the port, and prior to the application of a second shifting tool-actuating pressure differential, supplying treatment material through the opened port; and after sufficient treatment material has been supplied through the opened port, suspending the supplying of the treatment material.

3. The method as claimed in claim 2;

wherein the second shifting tool includes one or more hydraulic hold down buttons.

4. The method as claimed in claim 1;

wherein the second shifting tool includes one or more hydraulic hold down buttons.

5. The method as claimed in claim 1;

wherein the at least a reduction in fluid pressure that is effected by the uphole displacement of the upper assembly portion relative to the bottom assembly portion also effects retraction of the sealing member.

6. The method as claimed in claim 5;

wherein the second shifting tool includes one or more hydraulic hold down buttons.

7. A method of stimulating a formation within a wellbore that is lined with a wellbore string, the wellbore string including a port and a flow control member, wherein the flow control member is displaceable relative to the port for effecting opening and closing of the port, comprising:

deploying a workstring including a bottomhole assembly within the wellbore string, wherein the bottomhole assembly includes:

an uphole assembly portion including a valve plug and an actuatable second shifting tool;

a downhole assembly portion including a valve seat and an actuatable first shifting tool;

actuating the first shifting tool such that the first shifting tool becomes disposed in gripping engagement with the flow control member;

establishing a first sealing interface, wherein the sealing interface is effected, at least in part, by:

(a) sealing engagement or substantially sealing engagement between an actuated sealing element and the flow control member;

(b) seating of the valve plug on the valve seat;

applying a displacement-urging pressure differential across the sealing interface by supplying of pressurized fluid uphole of the sealing interface such that, in response, the actuated first shifting tool urges downhole displacement of the flow control member relative to the port such that the opening of the port is effected by the displacement;

after the displacing of the flow control member, and while the port is opened, and the pressure differential is existing across the sealing interface, actuating the second shifting tool such that the second shifting tool is exerting a gripping force against the flow control member; and while a reduced pressure differential is existing across the sealed interface, and while the second shifting tool is exerting the gripping force against the flow control member, applying an uphole force to the workstring such that the second shifting tool effects uphole displacement of the flow control member such that the port becomes closed.

8. The method as claimed in claim 7;

wherein the pressure differential, that is existing across the sealing interface, when the uphole force is applied to the workstring, is an instantaneous shut-in pressure.

9. The method as claimed in claim 7;

wherein, after the displacing of the flow control member from the closed position to the open position, sufficient time is elapsed prior to the closing of the port by the second shifting tool such that fluid, that is disposed uphole of the sealing interface, is imbibed into the formation via the opened port such that the reduction of the pressure differential across the sealing interface is effected by at least the imbibition.

10. The method as claimed in claim 9;

wherein the reduced pressure differential, that is existing across the sealing interface, when the uphole force is applied to the workstring, is an instantaneous shut-in pressure.

11. The method as claimed in claim 7, further comprising:

after the opening of the port, bleeding fluid from uphole of the sealing interface to the surface such that the reduced pressure differential is established across the sealing interface.

12. The method as claimed in claim 7, further comprising:

after the opening of the port, and prior to the application of an actuating pressure differential, supplying treatment material through the opened port; and after sufficient treatment material has been supplied through the opened port, suspending the supplying of the treatment material.

13. The method as claimed in claim 12;

wherein, after the suspending of the supplying of the treatment material, sufficient time is elapsed prior to the closing of the port by the second shifting tool such that fluid, that is uphole of the sealing interface, is imbibed into the formation via the opened port.

* * * * *